US007367184B2

(12) United States Patent
Nakano et al.

(10) Patent No.: US 7,367,184 B2
(45) **Date of Patent: *May 6, 2008**

(54) FUEL INJECTION CONTROL DEVICE FOR INTERNAL COMBUSTION ENGINE

(75) Inventors: Tomoaki Nakano, Nagoya (JP); Yuuiki Sakamoto, Kariya (JP)

(73) Assignee: Denso Corporation, Kariya (JP)

( * ) Notice: Subject to any disclaimer, the term of this patent is extended or adjusted under 35 U.S.C. 154(b) by 225 days.

This patent is subject to a terminal disclaimer.

(21) Appl. No.: 11/115,372

(22) Filed: Apr. 27, 2005

(65) Prior Publication Data

US 2005/0241300 A1 Nov. 3, 2005

(30) Foreign Application Priority Data

Apr. 28, 2004 (JP) ..... 2004-133365
Apr. 28, 2004 (JP) ..... 2004-133366
Apr. 1, 2005 (JP) ..... 2005-106593

(51) Int. Cl.
*F01N 3/00* (2006.01)

(52) U.S. Cl. ..... 60/289; 60/276; 60/285; 60/290; 60/291

(58) Field of Classification Search ..... 60/274, 60/276, 285, 289, 290, 291
See application file for complete search history.

(56) References Cited

U.S. PATENT DOCUMENTS 5,228,286 A * 7/1993 Demura ..... 60/276
5,303,548 A * 4/1994 Shimizu et al. ..... 60/277
5,325,663 A * 7/1994 Itoh ..... 60/274
5,560,199 A * 10/1996 Agustin et al. ..... 60/274
5,720,166 A 2/1998 Toshiro et al. ..... 60/284
5,743,085 A * 4/1998 Takaku et al. ..... 60/276
6,978,600 B2 * 12/2005 Hirooka ..... 60/289
2004/0172934 A1 9/2004 Kita et al. ..... 60/289

FOREIGN PATENT DOCUMENTS

JP 2910034 4/1999

OTHER PUBLICATIONS

U.S. Appl. No. 11/020,156, filed Dec. 27, 2004, Nakano et al.
U.S. Appl. No. 11/020,156 filed Dec. 27, 2004; Nakano et al.

* cited by examiner

*Primary Examiner*—Binh Q. Tran
(74) *Attorney, Agent, or Firm*—Nixon & Vanderhye P.C.

(57) ABSTRACT

A fuel injection amount control device is used for an internal combustion engine. A secondary air supply device supplies secondary air into an exhaust passage of the internal combustion engine. Flow amount calculating circuitry calculates a secondary air flow amount. The secondary air flows into the exhaust passage. Target air fuel ratio setting circuitry sets a target air fuel ratio when secondary air is supplied. Fuel amount correcting circuitry corrects a fuel injection amount in accordance with a current value of the secondary air flow amount such that the air fuel ratio on a downstream side of an inlet of secondary air in the exhaust passage becomes the target air fuel ratio when secondary air is supplied. Target changing circuitry monitors increase and decrease in the secondary air flow amount. The target changing circuitry changes the target air fuel ratio to one of a rich side and a lean side in accordance with the increase and decrease in the secondary air flow amount.

31 Claims, 18 Drawing Sheets

FIG. 18A
| | | Ne | | |
|---|---|---|---|---|
| | | LOW | MIDDLE | HIGH |
| LOAD | LOW | | | (SMALL) |
| | MIDDLE | | | |
| | HIGH | (LARGE) | | |
FIG. 18B
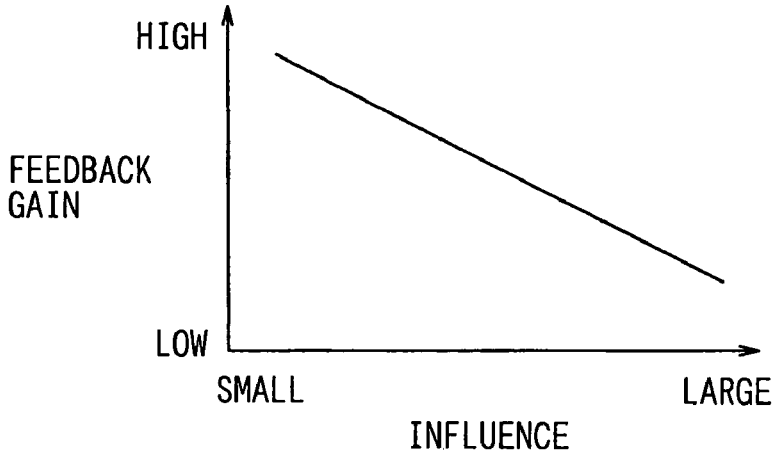
FIG. 19
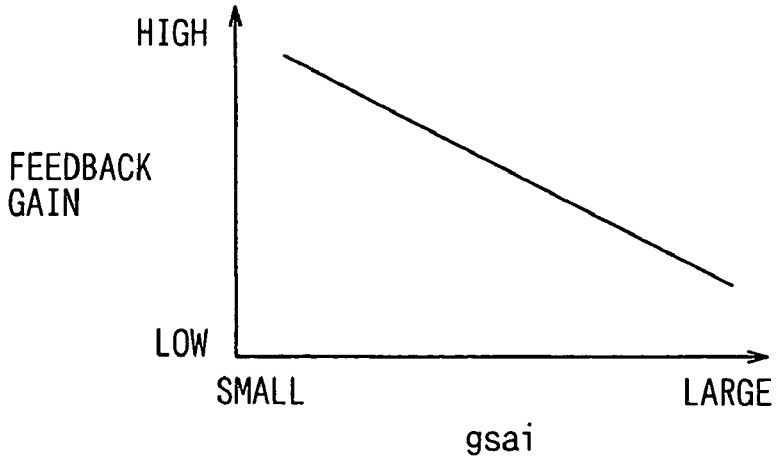

FUEL INJECTION CONTROL DEVICE FOR INTERNAL COMBUSTION ENGINE

CROSS REFERENCE TO RELATED APPLICATIONS

This application is based on and incorporates herein by reference Japanese Patent Applications No. 2004-133365 filed on Apr. 28, 2004, No. 2004-133366 filed on Apr. 28, 2004, and No. 2005-106593 filed on Apr. 1, 2005.

FIELD OF THE INVENTION

The present invention relates to a fuel injection control device for an internal combustion engine.

BACKGROUND OF THE INVENTION

A catalyst is provided to an exhaust pipe of an internal combustion engine to purify exhaust gas. In a conventional operation, secondary air is supplied to the upstream of a catalyst using an air pump to enhance purification efficiency of the catalyst.

When secondary air is supplied, a fuel injection amount is controlled such that the air fuel ratio (combustion air fuel ratio) of mixture gas, which is supplied to the engine, becomes high to the rich side. The air fuel ratio (A/F ratio) is detected using an air fuel ratio sensor (A/F sensor) arranged in the vicinity of an inlet of the catalyst, so that the A/F ratio is controlled in accordance with the detection signal of the A/F sensor. However, in this situation, the injection amount of fuel may be excessively increased. That is, when secondary air is supplied, the amount of fuel injection is increased in accordance with a flow amount of secondary air. Subsequently, when supply of the secondary air is stopped, the amount of fuel injection quickly changes. For example, when the flow amount of secondary air temporarily increases or temporarily decreases corresponding to change of an operating condition of the engine, the amount of fuel injection may be excessively increased. As a result, drivability may be deteriorated, and emission of exhaust gas may increase.

Therefore, when secondary air is supplied, feedback control of the A/F ratio may be prohibited to evade such deterioration in drivability and increase in emission. According to JP-B2-2910034, when secondary air is supplied, and an A/F sensor outputs a rich signal, feedback control of the A/F ratio is operated. Besides, when secondary air is supplied, and the A/F sensor outputs a lean signal, feedback control of the A/F ratio is prohibited.

However, the injection amount of fuel is preferably compensated, that is, the A/F ratio is preferably controlled in accordance with increase and decrease in flow amount of secondary air for maintaining exhaust emission in a favorable condition, even when secondary air is supplied. Therefore, the amount of fuel injection needs to be compensated when secondary air is supplied.

SUMMARY OF THE INVENTION

In view of the foregoing problems, it is an object of the present invention to provide a fuel injection control device for an internal combustion engine, the fuel injection control device being capable of compensating in the injection amount of fuel when secondary air is supplied, so that drivability is enhanced and emission of exhaust gas is decreased.

It is another object of the present invention to provide a fuel injection control device for an internal combustion engine, the fuel injection control device being capable of controlling the injection amount of fuel when secondary air is stopped, so that drivability is enhanced.

According to the present invention, a fuel injection amount control device for an internal combustion engine includes a secondary air supply device, a flow amount calculating means, a target air fuel ratio setting means, a fuel amount correcting means, and a target changing means. The secondary air supply device supplies secondary air into an exhaust passage of the internal combustion engine. The flow amount calculating means calculates a secondary air flow amount. The secondary air flows into the exhaust passage. The target air fuel ratio setting means sets a target air fuel ratio when secondary air is supplied. The fuel amount correcting means corrects a fuel injection amount in accordance with a current value of the secondary air flow amount, such that the air fuel ratio on a downstream side of an inlet of secondary air in the exhaust passage becomes the target air fuel ratio when secondary air is supplied. The target changing means monitors increase and decrease in the secondary air flow amount. The target changing means changes the target air fuel ratio to one of a rich side and a lean side in accordance with the increase and decrease in the secondary air flow amount.

Alternatively, a fuel injection amount control device for an internal combustion engine includes a secondary air supply device, a flow amount calculating means, a target air fuel ratio setting means, an air fuel ratio detecting means, and an air fuel ratio correction amount calculating means.

The secondary air supply device supplies secondary air into an exhaust passage of the internal combustion engine. The flow amount calculating means that calculates a secondary air flow amount. The secondary air flows into the exhaust passage. The target air fuel ratio setting means sets a target air fuel ratio on a downstream side of an inlet of secondary air in the exhaust passage. The air fuel ratio detecting means detects an actual air fuel ratio on the downstream side of the inlet of secondary air in the exhaust passage. The air fuel ratio correction amount calculating means calculates an air fuel ratio correction amount in accordance with a deviation between an air fuel ratio detected using the air fuel ratio detecting means and the target air fuel ratio. The air fuel ratio is feedback controlled using the air fuel ratio correction amount calculated using the air fuel ratio correction amount calculating means.

The fuel injection amount control device further includes a guard setting means and a correction amount restricting means. The guard setting means sets a correction amount guard value on at least an increasing side of the air fuel ratio correction amount in accordance with the secondary air flow amount calculated using the flow amount calculating means when secondary air is supplied. The correction amount restricting means restricts the air fuel ratio correction amount with the correction amount guard value, which is set using the guard setting means.

Alternatively, a fuel injection amount control device for an internal combustion engine includes a secondary air supply device, a target air fuel ratio setting means, a fuel amount correcting means, and a target value changing means. The secondary air supply device supplies secondary air into an exhaust passage of the internal combustion engine. The target air fuel ratio setting means sets a first target value as a target air fuel ratio when secondary air is supplied. The target air fuel ratio setting means sets a second target value as a target air fuel ratio when secondary air is stopped. The fuel amount correcting means corrects a fuel injection amount such that the air fuel ratio, which is on a downstream side of the inlet of secondary air in the exhaust passage, becomes the target air fuel ratio. When the target air fuel ratio is switched from the first target value to the second target value in a condition in which secondary air is stopped, the target value changing means initially sets the target air fuel ratio on a rich side with respect to the second target value, and thereafter changes the target air fuel ratio to the second target value.

Thereby, drivability and emission of exhaust gas can be restricted from being deteriorated.

BRIEF DESCRIPTION OF THE DRAWINGS

The above and other objects, features and advantages of the present invention will become more apparent from the following detailed description made with reference to the accompanying drawings. In the drawings:

FIG. 18A is a data map for estimating an influence exerted by pulsation flow of exhaust gas, and FIG. 18B is a graph showing a relationship between the influence exerted by pulsation flow and feedback gain according to the fourth embodiment;

FIG. 19 is a graph showing a relationship between a flow amount gsai of secondary air and feedback gain according to the fourth embodiment;

DETAILED DESCRIPTION OF PREFERRED EMBODIMENTS

First Embodiment

An engine control system including an engine control device is applied to an internal combustion engine such as a vehicular multi-cylinder gasoline engine, in this embodiment. In the engine control system, an electronic control unit (ECU, control means) is used as a central device for controlling an amount of fuel injection (fuel injection amount) and ignition timing, for example.

Figure 1:
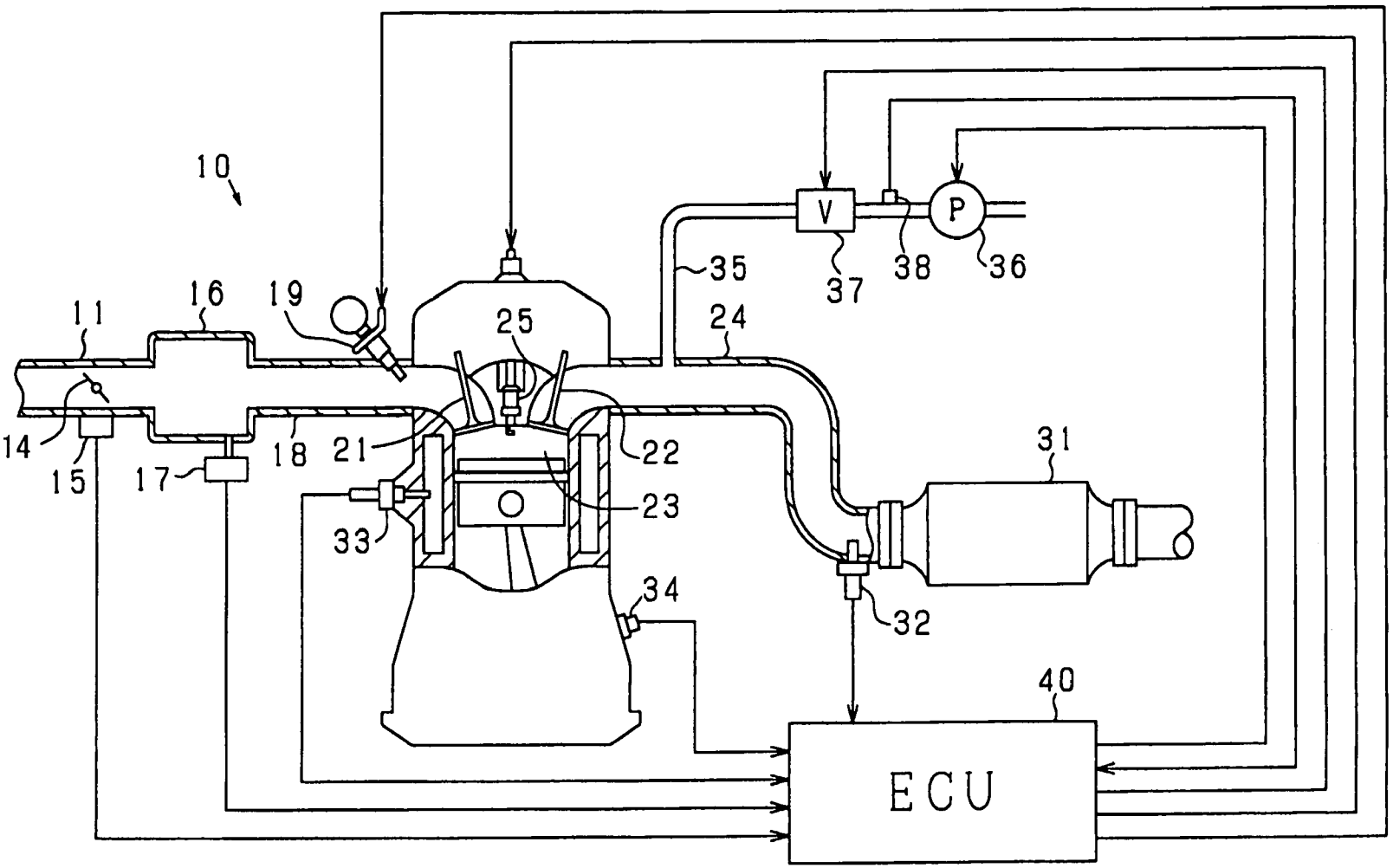
FIG. 1 is a schematic view showing an engine control device according to a first embodiment of the present invention.

As shown in FIG. 1, a throttle valve 14 and a throttle opening sensor 15 are provided to an intake pipe 11 of an engine 10. The throttle valve 14 is controlled in opening degree by an actuator such as a DC motor. The throttle opening sensor 15 detects opening degree of the throttle valve 14. A surge tank 16 is provided to the downstream side of the throttle valve 14. An intake pipe pressure sensor 17 is provided to the surge tank 16 for detecting pressure in the intake pipe 11. An intake manifold 18 connects to the surge tank 16 for introducing air to respective cylinders of the engine 10. A fuel injection valve 19 is provided to the intake manifold 18, such that the fuel injection valve 19 is arranged in the vicinity of each intake port of each cylinder. The fuel injection valve 19 is operated using a solenoid for directly supplying fuel.

An intake valve 21 and an exhaust valve 22 are respectively provided to the intake port and an exhaust port in the engine 10. The intake valve 21 opens, so that mixture gas, which includes air and fuel, is introduced into a combustion chamber 23. The exhaust valve 22 opens, so that exhaust gas, which is after combustion, is exhausted to an exhaust pipe 24. An ignition plug 25 is provided to each cylinder head of the engine 10. The ignition plug 25 is applied with high voltage at a predetermined ignition timing from an ignition coil or the like via an ignition device (not shown). The ignition plug 25 is applied with high voltage, so that spark is generated between electrodes, which oppose to each other, in each ignition plug 25. Thereby, mixture gas, which is introduced into the combustion chamber 23, is ignited, so that the mixture gas is burned.

A catalyst 31 such as a three-way catalyst is provided to the exhaust pipe 24 to purify CO, HC, NOx, and the like, which are contained in exhaust gas. An air fuel sensor (A/F sensor) 32 such as a linear A/F sensor and an O2 sensor is provided to the upstream side of the catalyst 31. The A/F sensor 32 measures an air fuel ratio (A/F ratio) of mixture gas by detecting the A/F ratio of exhaust gas. A cooling water temperature sensor 33 and a crank angle sensor 34 are provided to a cylinder block of the engine 10. The cooling water temperature sensor 33 detects temperature of cooling water. The crank angle sensor 34 outputs rectangular crank angle signals at a predetermined crank angle such as 30° CA of the engine 10.

A secondary air pipe 35 is connected to the upstream side of the catalyst 31 in the exhaust pipe 24 as a secondary air supply system. A secondary air pump 36 is provided to the upstream side of the secondary air pipe 35. The secondary air pump 36 serves as a secondary air supply device. The secondary air pump 36 is constructed of a DC motor and the like, and is supplied with electric power from a vehicular battery (not shown), so that the secondary air pump 36 is operated. A valve 37 is provided to the downstream side of the secondary air pump 36, so that the valve 37 opens and closes the secondary air pipe 35. A pressure sensor 38 is provided between the secondary air pump 36 and the valve 37 to detect pressure in the secondary air pipe 35.

The various sensors respectively output signals, and the signals are input to the ECU 40, which controls the engine 10. The ECU 40 is mainly constructed of a microcomputer including a CPU, a ROM, a RAM, and the like. Various programs stored in the ROM are executed, so that the ECU 40 controls an amount of fuel injection (fuel injection amount TAU) of the fuel injection valve 19 and an ignition timing of the ignition pug 25 in accordance with an operating condition of the engine 10. The ECU 40 operates the secondary pump 36, so that the ECU 40 controls supply of secondary air to rapidly activate the catalyst 31 when the engine 11 is started, for example.

Next, control of the fuel injection amount is described. The fuel injection amount is controlled when secondary air is supplied. When secondary air is supplied, secondary air flows into the exhaust pipe 24, and the fuel injection amount is increased in accordance with a flow amount (secondary air flow amount) of the secondary air. In this case, the secondary air flow amount may be calculated generally in accordance with a detection signal (secondary air pressure) Ps of the pressure sensor 38 in a condition where the valve 37 is opened and the secondary pump 36 is turned ON, i.e., the secondary pump 36 is operated. However, in this embodiment, the secondary air flow amount is calculated in accordance with pressure difference between secondary air pressure Ps and standard pressure to evade deterioration in calculation accuracy due to manufacturing tolerances of the secondary pump 36 and the pressure sensor 38. For example, shutoff pressure P0 is detected as the standard pressure in a condition, in which the valve 37 is closed and the secondary air pump 36 is turned ON, and the secondary air flow amount Qa is calculated in accordance with a formula (1).

$$Qa = CA\sqrt{\frac{2}{\rho}(P0 - Ps)} \tag{1}$$

Here, β is fluid density, C is a coefficient, A is a cross sectional area of the passage. The fluid density β varies corresponding to temperature variation. Therefore, the fluid density β may be corrected based on temperature of intake air.

A target A/F ratio is set when secondary air is supplied. The target A/F ratio, which is set when secondary air is supplied, is different from a target A/F ratio, which is set in a normal condition, in which secondary air is not supplied. That is, fuel injection amount is controlled by setting a relatively lean A/F ratio as the target A/F ratio when secondary air is supplied, for example. In this case, the A/F ratio (excess coefficient of air) λ and an A/F ratio (combustion A/F) λ1 of combustion gas, which is burned in the combustion chamber 23 of the engine 10 have a relationship shown by a formula (2).

$$\lambda 1 = \frac{\lambda 2 \times ga}{ga + gsai} \tag{2}$$

Here, λ2 shows an A/F ratio in the inlet of the catalyst 31, ga shows an amount (intake air amount) of air flowing into the engine, gsai shows the secondary air flow amount. Here, both the intake air amount ga and the secondary air flow amount gsai show mass flow rates. The secondary air flow amount gsai, which is the mass flow rate, is converted from the secondary air flow amount Qa, which is a volumetric flow rate.

The combustion A/F λ1 is the excess coefficient of air. The inverse number of the combustion A/F λ1 is an excess coefficient of fuel 1/λ1. The excess coefficient of fuel 1/λ1 is a correction coefficient fsai for increasing the fuel injection amount TAU when secondary air is supplied. The correction coefficient fsai is referred as a secondary air correction coefficient fsai.

When the A/F λ2 in the inlet of the catalyst 31 is set to be the target A/F λtg, a formula (3) is obtained from the formula (2).

$$fsai = \frac{1}{\lambda tg} \times \frac{gsai + ga}{ga} \tag{3}$$

According to the formula (3), the secondary air correction coefficient fsai, when secondary air is supplied, can be calculated using the secondary air flow amount gsai, the intake air amount ga, and the target A/F λtg.

Figure 2:
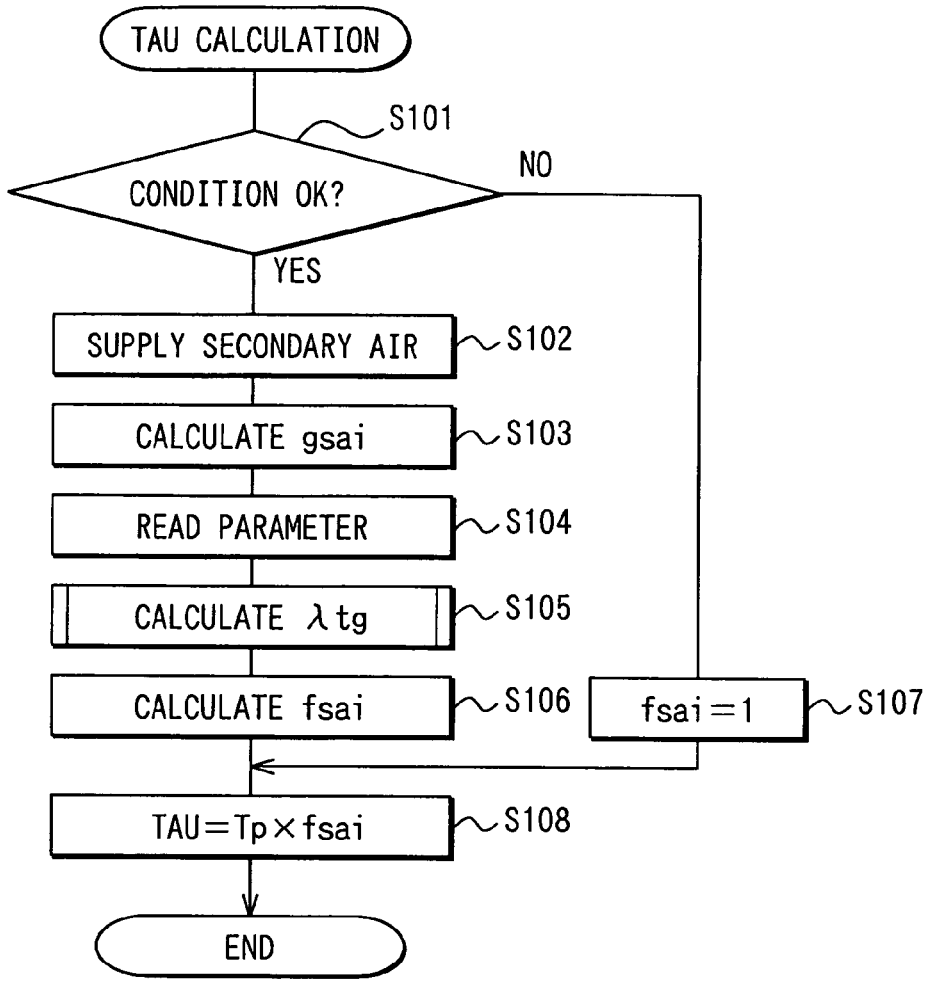
FIG. 2 is a flowchart showing a calculating routine of an amount TAU of fuel injection, according to the first embodiment.

As shown in FIG. 2, a routine for calculating the fuel injection amount TAU is executed by the ECU 40 at a predetermined interval, for example. The routine for calculating the fuel injection amount TAU is partially taken out of routines executed by the ECU 40 for calculating the fuel injection amount TAU, the routines for calculating the fuel injection amount TAU being related to a routine for supplying secondary air.

In step S101, it is determined whether a condition for supplying secondary air is satisfied. When the condition for supplying secondary air is satisfied, the routine proceeds to S102, in which the valve 37 is opened, and the secondary air pump 36 is operated, so that secondary air is supplied into the exhaust pipe 24. Subsequently, the routine proceeds to S103, in which the flow amount of secondary air is calculated in accordance with the detection signal of the pressure sensor 38 or the like. Specifically, the secondary air flow amount Qa is calculated in accordance with the pressure difference between secondary air pressure Ps, which is detected using the pressure sensor 38, and standard pressure, i.e., shutoff pressure P0. The secondary air flow amount Qa, which is a volumetric flow rate, is converted to the secondary air flow amount gsai, which is the mass flow rate.

Subsequently, the routine proceeds to step 104, in which parameters, which are related to operating conditions, are read. The operating conditions include rotation speed Ne of the engine, the intake air amount ga, and the like. The routine proceeds to step 105, in which the target A/F λtg is calculated. The target A/F λtg is used when secondary air is supplied.

Next, calculation of the target A/F λtg is described.

Figure 3:
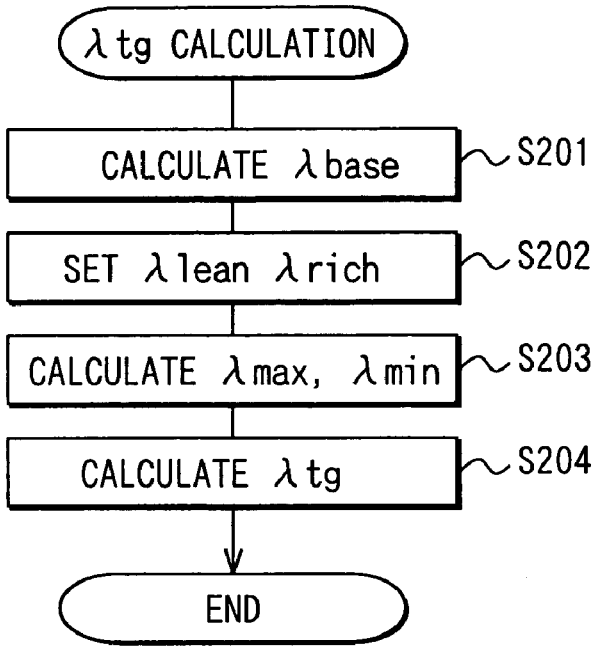
FIG. 3 is a flowchart showing a calculating routine of a target air fuel ratio λtg according to the first embodiment.

As shown in FIG. 3, in step 201, a target A/F base value λbase is calculated in accordance with current engine rotation speed Ne, current engine load and the like at the time. The target A/F base λbase is calculated using a target A/F ratio data map, which is used when secondary air is supplied. In this situation, the target A/F base value λbase is calculated such that emission of exhaust gas becomes in a preferable condition when secondary air is supplied. The target A/F base value λbase is set to be 10.5, for example.

The routine proceeds to S202, in which an allowable combustion A/F λlean on the lean side and an allowable combustion A/F λrich on the rich side are set. The allowable combustion A/Fs λlean, λrich on both the lean and rich sides define a range of A/F ratio.

The combustion A/F (supply A/F) λ1, at which the mixture gas burns in the engine, are allowed within a range of A/F ratio, i.e., the allowable combustion A/Fs λlean, λrich. The allowable combustion A/Fs λlean, λrich may be set in accordance with cooling water temperature WT of the engine, time elapsed after starting the engine, for example. More specifically, the allowable combustion A/Fs λlean, λrich are set in accordance with the relationship shown in FIG. 4. According to FIG. 4, as the cooling water temperature WT of the engine becomes high, both the allowable combustion A/Fs λlean, λrich are entirely shifted to the stoichiometric side. The cooling water temperature WT may represent temperature of the engine, and the time elapsed after starting the engine may represent the engine operating condition.

When the cooling water temperature WT of the engine becomes equal to or greater than a predetermined temperature such as 80° C., the engine is warmed up. In this situation, the allowable combustion A/F ratio (lean allowable combustion A/F) clean on the lean side is set to be equal to 1.0, and the allowable combustion A/F ratio (rich allowable combustion A/F) λrich on the rich side is set to be equal to 0.7, for example.

The routine proceeds to S203, in which a guard value (lean side guard) λmax of the target A/F λtg on the lean side and a guard value (rich side guard) λmin of the target A/F λtg on the rich side are calculated. The lean and rich side guards λmax, λmin are calculated in accordance with the lean and rich allowable combustion A/Fs λlean, λrich and the secondary air flow amount gsai. Specifically, the lean and rich side guards λmax, λmin are calculated using a formula (4).

$$\lambda\max = \lambda lean \times \frac{ga + gsai}{ga} \qquad (4)$$

$$\lambda\min = \lambda rich \times \frac{ga + gsai}{ga}$$

The routine proceeds to S204, in which the target A/F λtg is calculated while the target A/F base value λbase is guarded by the lean and rich side guards λmax, λmin. In this calculation, when a relationship λmin<μbase <λmax is satisfied, λtg is set to be λbase. Besides, when a relationship λbase ≦λmin is satisfied, λtg is set to be λmin. Besides, when a relationship λbase≧λmax is satisfied, λtg is set to be λmax.

As referred to FIG. 2, the routine proceeds to S106 after completing the processing in S105. In S106, the secondary air correction coefficient fsai is calculated using the secondary air flow amount gsai, the intake air amount ga, and the target A/F λtg based on the formula (3).

On the contrary, when the condition for supplying secondary air is not satisfied in S101, the routine proceeds to S107, in which the secondary air correction coefficient fsai is set to be 1.

The secondary air correction coefficient fsai is calculated in S106 or S107, and the routine proceeds to S108. In S108, a standard fuel injection amount Tp is multiplied with the secondary air correction coefficient fsai, so that the fuel injection amount TAU is calculated as the product. Here, the standard fuel injection amount Tp is calculated in accordance with the parameters related to the operating conditions such as the rotation speed Ne of the engine and the intake air amount ga.

Figure 5:
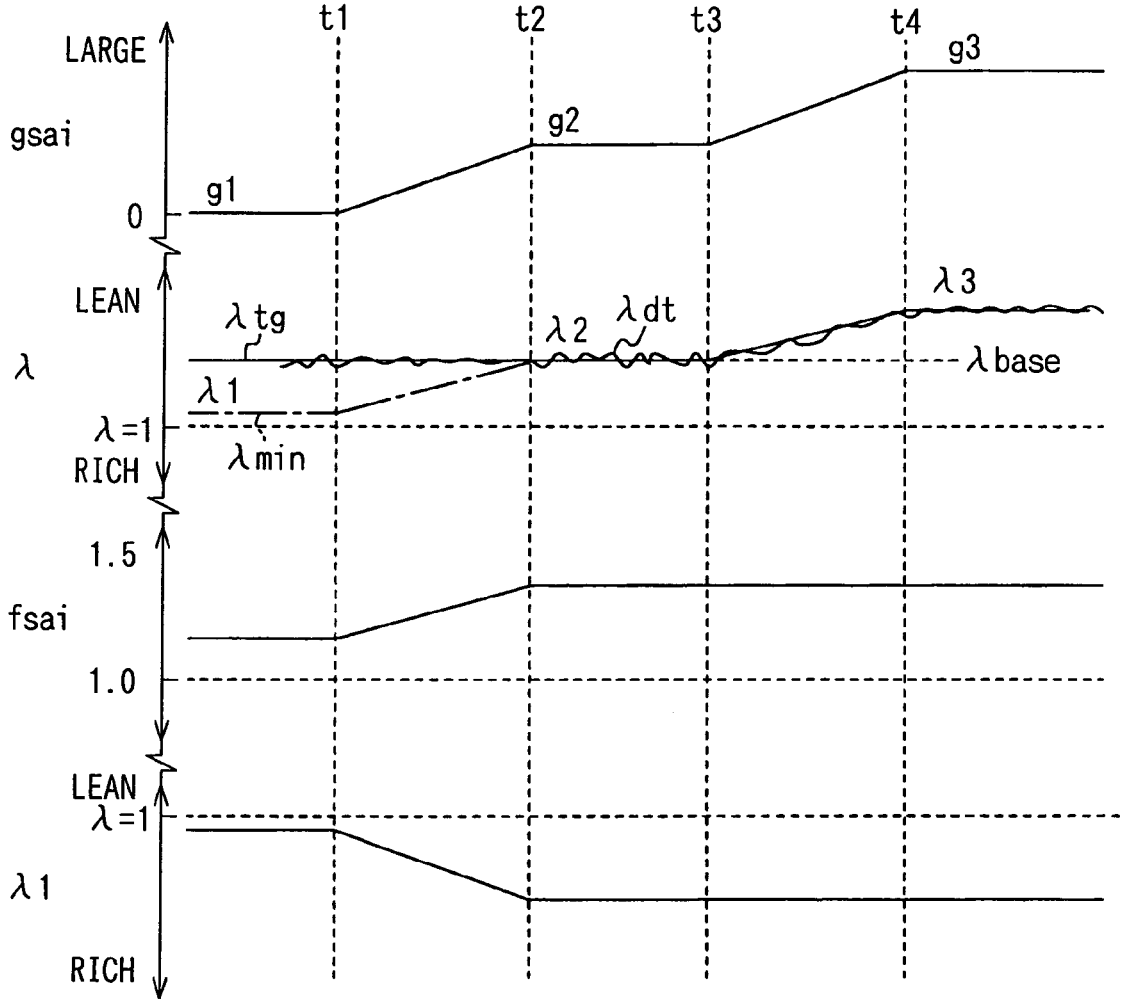
FIG. 5 is a time chart showing behaviors of parameters when secondary air is supplied, according to the first embodiment.

Next, a setting procedure of the target A/F λtg and the like in a condition, in which the secondary air flow amount gsai changes, is specifically described in reference to the time chart shown in FIG. 5. As shown in FIG. 5, the secondary air flow amount gsai is g1 in the period before t1, the secondary air flow amount gsai is g2 in the period between t2 and t3, and the secondary air flow amount gsai is g3 in the period after t4 (g1<g2<g3).

The target A/F λtg, the rich side guard λmin, and a detection A/F λdt are shown in FIG. 5. The rich side guard λmin is shown by a dotted line. The rich side guard λmin is equal to the target A/F λtg in the period after t2. The target A/F λtg is equal to the target A/F base value λbase in the period before t2.

As time elapses, the secondary air flow amount gsai increases from g1 to g2 and g3. According to the formula (4), as the secondary air flow amount gsai increases, the rich side guard λmin increases from λ1 to λ2 and λ3. In this situation, in the period before t2, λbase is greater than λmin and λtg is equal to λbase. Besides, in the period after t2, λbase≦λmin and λtg =λmin. Specifically in the period after t3, as the secondary air flow amount gsai increases, the target A/F λtg is set to be on the lean side with the rich side guard λmin.

As the secondary air flow amount gsai increases, the secondary air correction coefficient fsai increases, so that the fuel injection amount TAU increases. Thereby, unburned fuel reacts with secondary air in the exhaust pipe 24, so that the catalyst 31 effectively increases in temperature. However, in the period after t3, the target A/F λtg is set to be on the lean side with the rich side guard λmin, so that the secondary air correction coefficient fsai is restricted from being further changed. In the period after t3, the combustion A/F λ1 is restricted from being further changed to the rich side. In the period after t3, the secondary air correction coefficient fsai and the combustion A/F λ1 are restricted from being further changed as described above, so that drivability and emission of exhaust gas can be restricted from being deteriorated.

Figure 6:
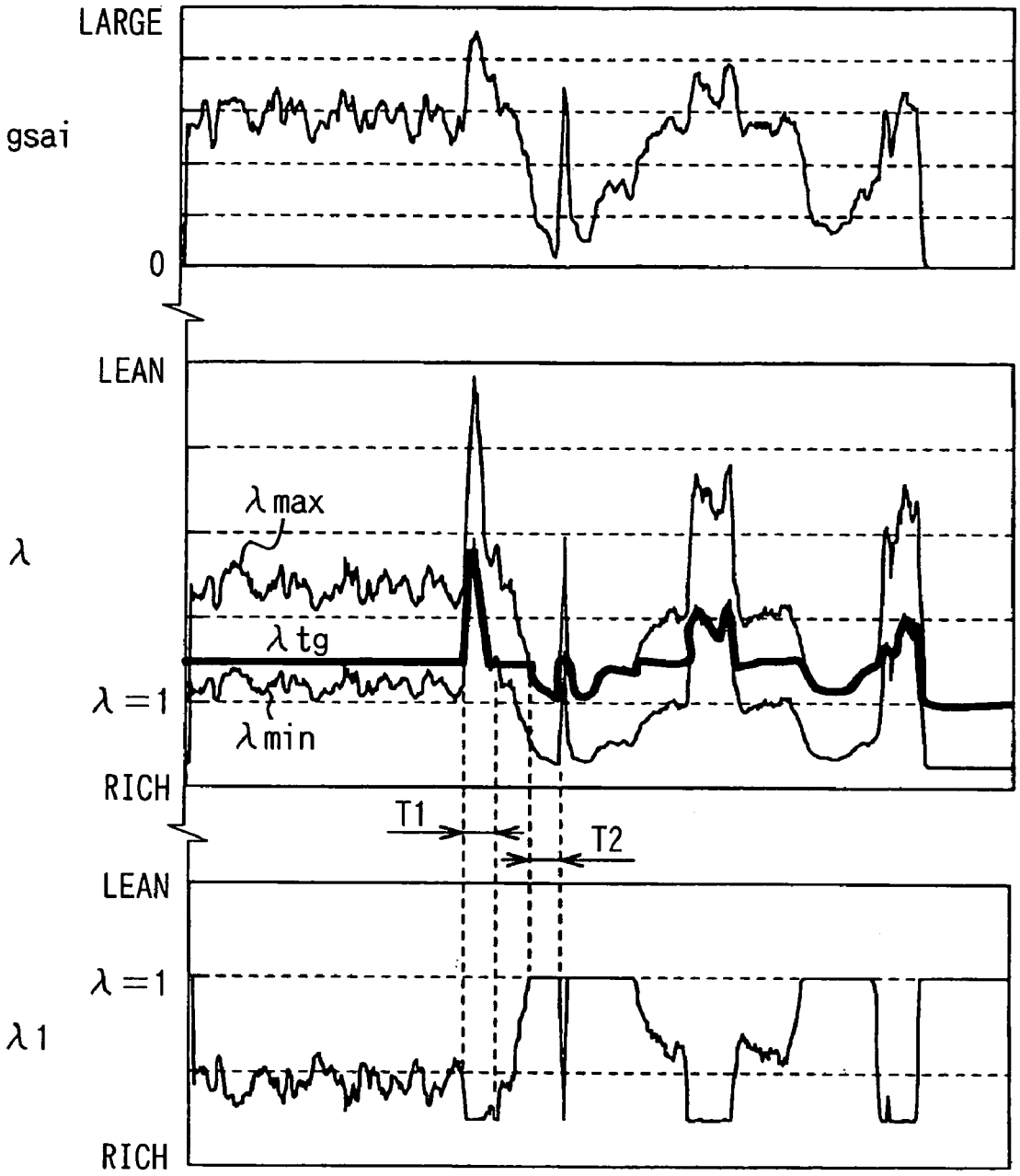
FIG. 6 is a time chart showing a measurement result of a flow amount gsai of secondary air, the air fuel ratio λ, and the combustion air fuel ratio λ1.

As shown in FIG. 6, a bold line shows the target A/F λtg. As shown in the upper and middle charts in FIG. 6, in the period T1, the secondary air flow amount gsai temporarily increases. However, as shown in the lower chart in FIG. 6, the combustion A/F λ1 is restricted from being excessively rich within a predetermined combustion A/F λ1, i.e., within the rich allowable combustion A/F λrich. As shown in the upper and middle charts in FIG. 6, in the period T2, the secondary air flow amount gsai temporarily decreases. In this situation, the target A/F λtg is set to be on the rich side with the lean side guard λmax. Thereby, as shown in the lower chart in FIG. 6, the combustion A/F λ1 is restricted within a predetermined combustion A/F λ1, i.e., within the lean allowable combustion A/F clean.

Thus, the following effects can be produced.

When secondary air is supplied, the lean and rich side guards λmax, λmin are set in accordance with increase and decrease in the secondary air flow amount gsai, and the target A/F λtg is set based on the lean and rich side guards λmax, λmin. Thereby, the fuel injection amount TAU can be properly corrected even when secondary air is supplied. Thus, drivability and emission of exhaust gas can be improved.

The lean and rich side guards λmax, λmin are calculated in accordance with the rich and lean allowable combustion A/Fs λrich, λlean and the secondary air flow amount gsai. Thereby, the combustion A/F λ1 can be restricted from being excessively rich and from being excessively lean when secondary air is supplied.

The secondary air flow amount Qa is calculated in accordance with the differential pressure between the secondary air pressure Ps and shutoff pressure P0, i.e., standard pressure. Thereby, even when atmospheric pressure changes, the secondary air flow amount Qa can be calculated without being affected by change in atmospheric pressure. Besides, even when manufacturing tolerances of the secondary pump 36 and the pressure sensor 38 exist, and even when pressure drop arises in the secondary air pipe 35, calculation of the secondary air flow amount Qa can be enhanced in accuracy. Thereby, the secondary air flow amount Qa can accurately calculated, so that control of the fuel injection amount TAU can be enhanced in accuracy.

Second Embodiment

In this embodiment, a secondary air correction coefficient faf is calculated in accordance with a deviation between the detection A/F λdt, which is detected using the A/F sensor 32, and the target A/F λtg. Besides, the fuel injection amount TAU is corrected using the secondary air correction coefficient faf, which is calculated by multiplying a feedback gain with the deviation between the detection A/F λdt and the target A/F λtg, in general.

In this embodiment, an upper guard α1 and a lower guard α2 are set relative to the secondary air correction coefficient faf for restricting the secondary air correction coefficient faf within a predetermined range when secondary air is supplied. The secondary air correction coefficient faf is restricted within the range between the guards α1 and α2. The upper guard α1 and the lower guard α2 serve as correction amount guard values.

The guards α1 and α2 are respectively calculated by respectively correcting a faf upper guard gdh and a faf lower guard gdl with correction terms, which are determined by the secondary air flow amount gsai, the intake air amount ga, and the target A/F λtg. The faf upper guard gdh and the faf lower guard gdl are used when the A/F ratio is feedback controlled in a normal condition, in which secondary air is not supplied.

The faf upper and lower guards gdh, gdl are used as guard values for restricting overshoots due to excessively correcting in the normal condition of A/F ratio feedback control. The faf upper guard gdh may be defined to be 1.0+K, and the faf lower guard gdl may be defined to be 1.0−K (K >0), for example.

Figure 7:
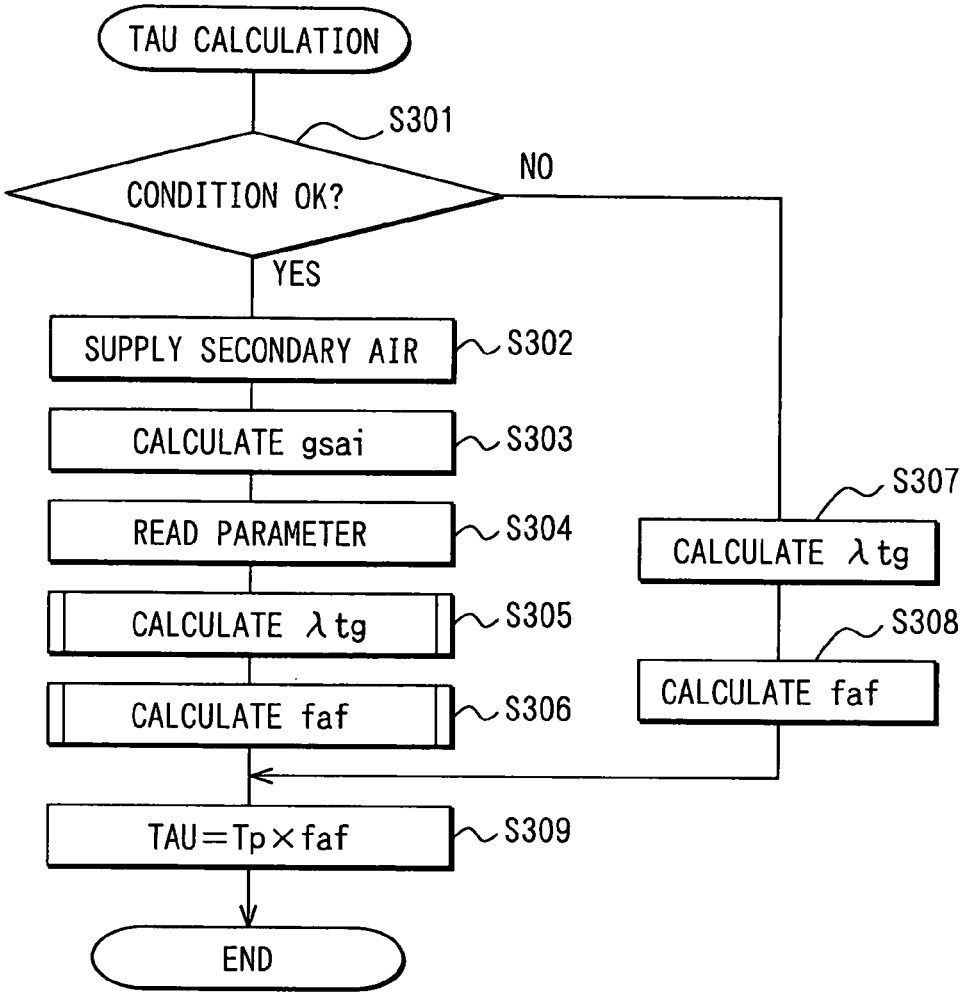
FIG. 7 is a flowchart showing a calculating routine of the amount TAU of fuel injection, according to a second embodiment of the present invention.

As shown in FIG. 7, a routine for calculating the fuel injection amount TAU is executed by ECU 40 at a predetermined interval, for example. The routine shown in FIG. 7 is executed instead of the routine shown in FIG. 2, and S301 to S305 are equivalent to S101 to S105. In step S301, it is determined whether a condition for supplying secondary air is satisfied. When the condition for supplying secondary air is satisfied, the routine proceeds to S302, in which the valve 37 is opened, and the secondary air pump 36 is operated, so that secondary air is supplied into the exhaust pipe 24. Subsequently, the routine proceeds to S303, in which the flow amount of secondary air gsai is calculated in accordance with the detection signal of the pressure sensor 38 or the like. Subsequently, the routine proceeds to step 304, in which parameters related to operating conditions are read. The operating conditions include rotation speed Ne of the engine, the intake air amount ga, and the like.

The routine proceeds to step 305, in which the target A/F λtg is calculated. The target A/F λtg is used when secondary air is supplied. As described in FIG. 3, the target A/F base value λbase, which is used when secondary air is supplied, is calculated using a data map or the like. As referred to the formula (4), the lean and rich side guards λmax, λmin are calculated based on the allowable combustion A/Fs λlean, λrich and the secondary air flow amount gsai. The allowable combustion A/Fs λlean, λrich are set in accordance with the cooling water temperature WT of the engine and the time elapsed after starting the engine, for example. The target A/F λtg is calculated while the target A/F base λbase is guarded by the lean and rich side guards λmax, λmin. In this situation, when a relationship λmin<λbase<λmax is satisfied, λtg is set to be λbase. Besides, when a relationship λbase≦λmin is satisfied, λtg is set to be λmin. Besides, when a relationship λbase≧λmax is satisfied, λtg is set to be λmax.

After calculating the target A/F λtg, the routine proceeds to S306, in which the secondary air correction coefficient faf is calculated. That is, a faf calculation routine shown in FIG. 8 is executed.

Figure 8:
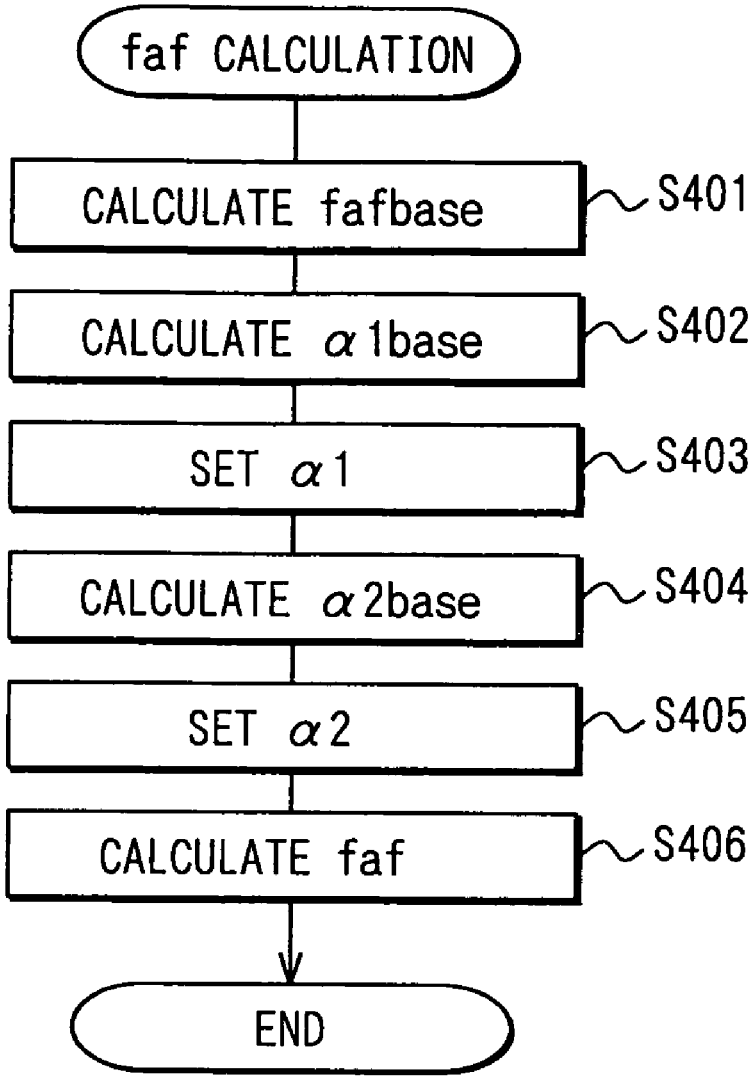
FIG. 8 is a flowchart showing a calculating routine of an air fuel ratio correction coefficient faf according to the second embodiment.

In S401 in the faf calculation routine shown in FIG. 8, a secondary air correction coefficient base value fafbase is calculated in accordance with the deviation between the detection A/F λdt, which is detected using the A/F sensor 32, and the target A/F λtg. Subsequently, the routine proceeds to S402, S403, in which a faf upper guard α1 is calculated. Specifically, an upper guard base value α1base is calculated in accordance with the faf upper guard gdh, which is used when secondary air is not supplied, the secondary air flow amount gsai, the intake air amount ga, and the targetA/F λtg using a formula (5).

$$\alpha 1base = gdh + \left\{ \frac{gsai + ga}{ga} \times \frac{1}{\lambda tg} - 1 \right\} \tag{5}$$

Besides, a processing is performed to the upper guard base value α1base for prohibiting quick change using a formula (6), so that the solution of the formula (6) is set as the faf upper guard α1.

$$\alpha 1_n = \max(\alpha 1_{n-1} - \Delta, \min(\alpha 1_{n-1} + \Delta, \alpha 1base)) \tag{6}$$

In the formula (6), the Δ is a range, in which the guard value is changed. In this embodiment, the Δ is fixed, however, the Δ may be variably set.

Subsequently, the routine proceeds to S404, S405, in which a faf lower guard α2 is calculated. Specifically, an lower guard base value α2base is calculated in accordance with the faf lower guard gdl, which is used when secondary air is not supplied, the secondary air flow amount gsai, the intake air amount ga, and the target A/F λtg using a formula (7).

$$\alpha 2base = gdl + \left\{\frac{gsai + ga}{ga} \times \frac{1}{\lambda tg} - 1\right\} \tag{7}$$

Besides, a processing is performed to the lower guard base value α2base for prohibiting quick change using a formula (8), so that the solution of the formula (8) is set as the faf lower guard α2.

$$\alpha 2_n = \max(\alpha 2_{n-1} - \Delta, \min(\alpha 2_{n-1} + \Delta, \alpha 2base)) \tag{8}$$

Here, filtering such as an averaging, moving average calculation, or the like can be used as a quick change prohibiting operation in the guard values in addition to the formulas (6), (8).

Subsequently, the routine proceeds to S406, in which the secondary air correction coefficient faf is calculated while the secondary air correction coefficient base value fafbase is guarded by the upper guard α1 and the lower guard α2. In this situation, when a relationship α2<fafbase<α1 is satisfied, faf is set to be fafbase. Besides, when a relationship fafbase≦α2 is satisfied, faf is set to be α2. Besides, when a relationship fafbase≧α1 is satisfied, faf is set to be α1.

As referred to FIG. 7, when the condition for supplying secondary air is not satisfied in S301, the routine proceeds to S307, in which the target A/F λtg is calculated in accordance with the current operating condition of the engine 10 at the time. The routine proceeds to S308, in which the secondary air correction coefficient faf is calculated in accordance with the deviation between the detection A/F λdt and the target A/F λtg. The steps S307, S308 are operated in the normal condition of control, i.e., in the condition when secondary air is not supplied.

After the secondary air correction coefficient faf is calculated in S306, S308, the routine proceeds to S309, in which the standard fuel injection amount Tp is multiplied with the secondary air correction coefficient faf, so that the product calculated in S309 is set as the fuel injection amount TAU. The standard fuel injection amount Tp is calculated in accordance with the parameters related to the operating conditions such as the rotation speed Ne of the engine and the intake air amount ga.

Figure 9:
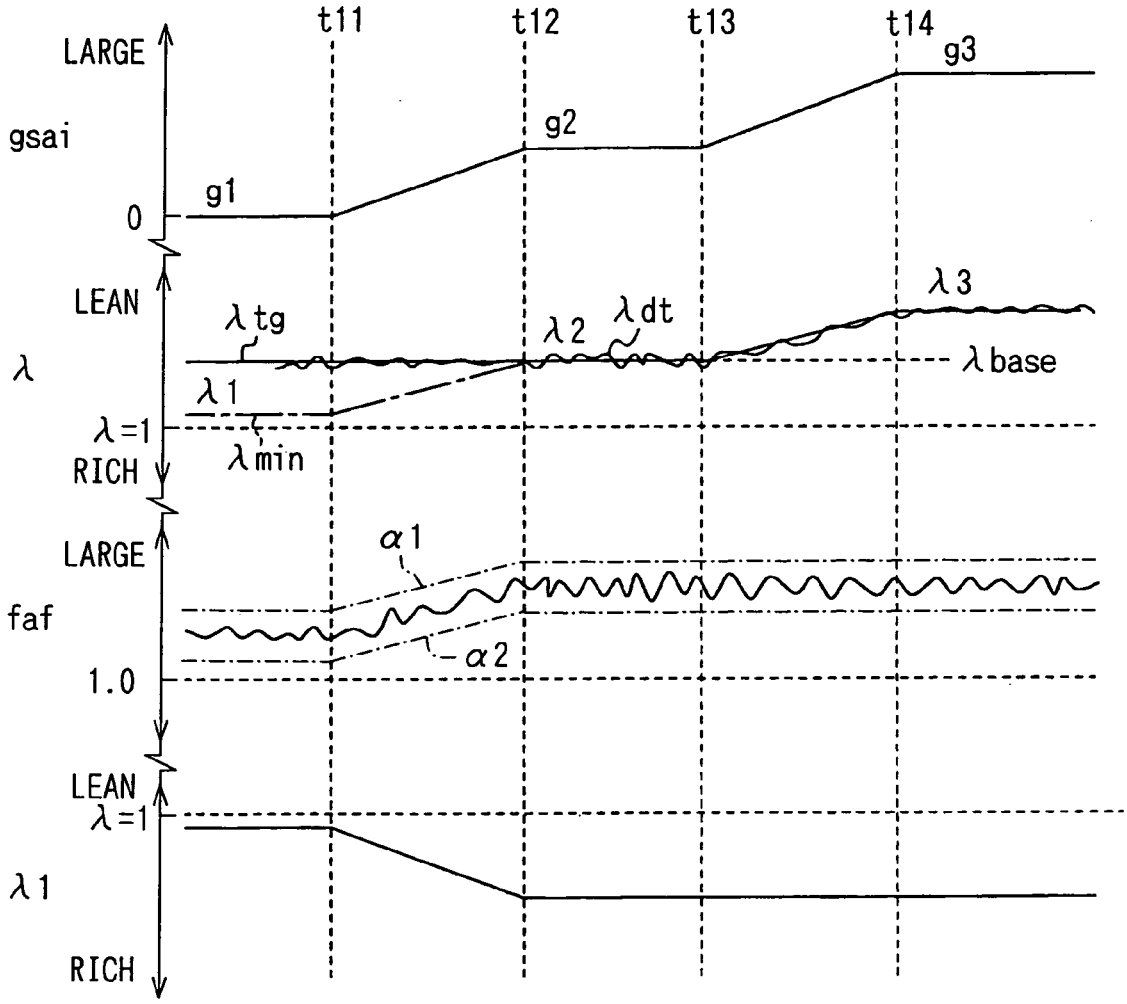
FIG. 9 is a time chart showing behaviors of parameters when secondary air is supplied, according to the second embodiment.

As shown in FIG. 9, the secondary air flow amount gsai is g1 in the period before t11, and is g2 in the period between t12 and t13, and is g3 in the period after t14 (g1<g2<g3) similarly to the time chart in FIG. 5.

The target A/F λtg, the rich side guard λmin, and a detection A/F λdt are shown in FIG. 9. The rich side guard λmin is shown by the dotted line. The rich side guard )min is equal to the target A/F λtg in the period after t12. The target A/F λtg is equal to the target A/F base value λbase in the period before t12. The intake air amount ga is constant.

The time chart shown in FIG. 9 is substantially equivalent to the time chart shown in FIG. 5 excluding the secondary air correction coefficient faf, the faf upper and lower guards α1, α2.

As the secondary air flow amount gsai changes, i.e., increases, the rich side guard λmin changes from λ1 to λ2 and λ3. In this situation, in the period after t12, λbase is equal to or less than λmin, and the target A/F λtg is guarded by the rich side guard λmin. In the period after t13, the target A/F λtg is set to be on the lean side by the rich side guard λmin.

As the secondary air flow amount gsai increases, the target A/F λtg is changed, so that the secondary air correction coefficient faf (more specifically, faf averaging value) increases. However, in the period after t13, the target A/F λtg is set to be on the lean side with the rich side guard λmin, so that the secondary air correction coefficient faf is restricted from being changed.

The upper and lower guards α1, α2 are generally set based on the faf upper and lower guards gdh, gdl, which are used when the A/F ratio is feedback controlled in a normal condition, in which secondary air is not supplied. The upper and lower guards α1, α2 are changed corresponding to the current secondary air flow amount gsai and the current target A/F λtg at the time. In this situation, the target A/F λtg is constant in the period before t13, and the upper and lower guards α1, α2 change corresponding to the secondary air flow amount gsai.

In the period after t13, the combustion A/F λ1 is restricted from being further changed to the rich side. In the period after t13, the secondary air correction coefficient faf and the combustion A/F λ1 are restricted from being further changed as described above, so that drivability and emission of exhaust gas can be restricted from being deteriorated.

As described in FIG. 8, the upper and lower guard base values α1base, α2base are calculated, and the quick change prohibiting operation is performed to the α1base and α2base as described in formulas (6), (8), so that the upper and lower guards α1, α2 are finally calculated. Next, the effect produced by this operation is described.

Figure 10A:
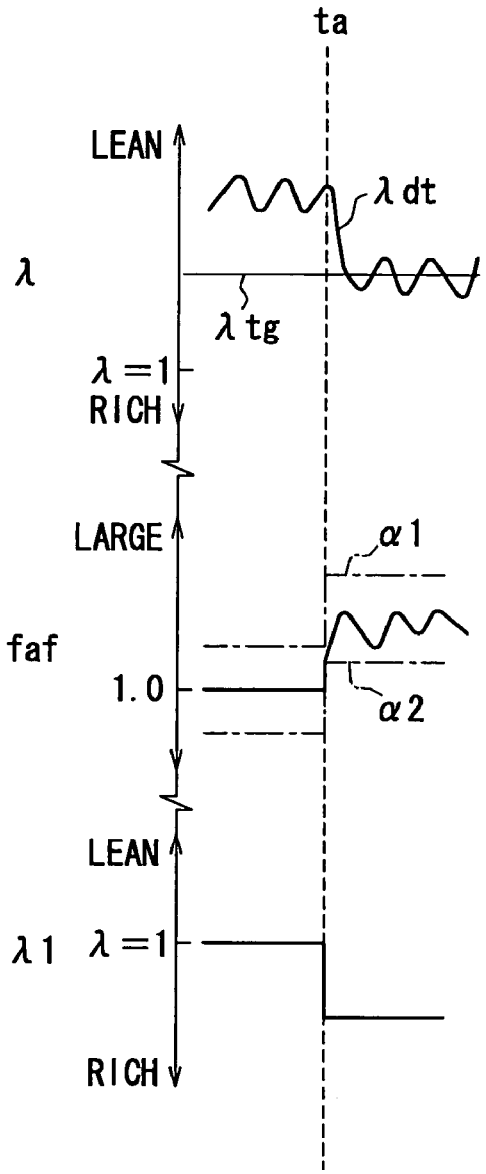
FIG. 10A is a time chart showing behaviors of parameters without a quick change prohibiting operation of an upper guard and a lower guard.

As shown in FIG. 10A, the feedback control of A/F ratio is started at the timing ta, so that the upper and lower guards α1, α2 are set in accordance with the secondary air flow amount gsai, the intake air amount ga, and the current target A/F λtg at the time. In this situation, the secondary air correction coefficient faf is forcibly increased by the lower guard α2, and the combustion A/F λ1 is stepwisely moved to the rich side. Accordingly, drivability is deteriorated.

Figure 10B:
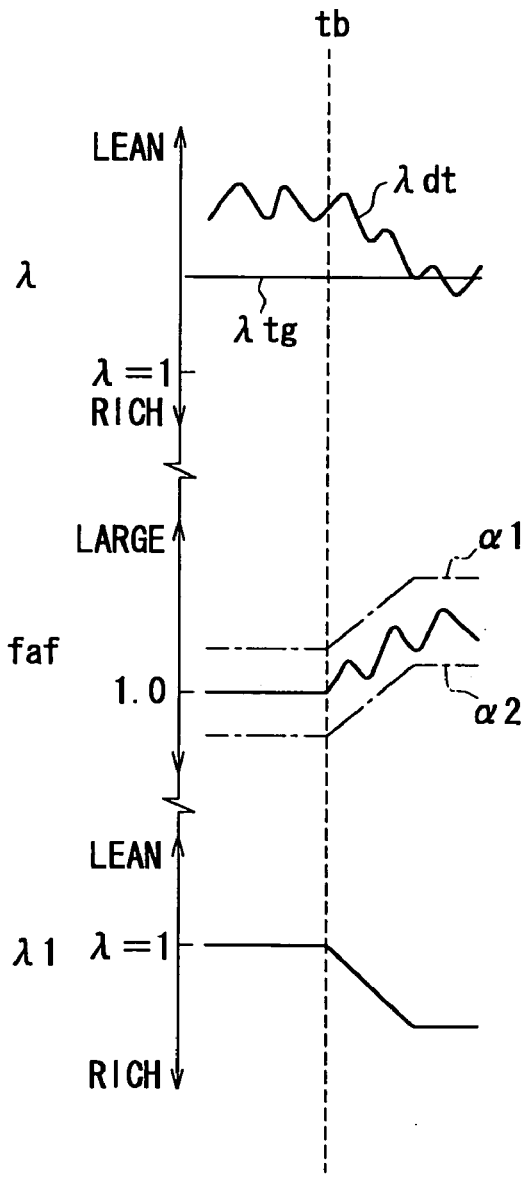
FIG. 10B is a time chart showing behaviors of parameters with the quick change prohibiting operation of the upper guard and the lower guard according to the second embodiment.

On the contrary, as shown in FIG. 10B, the feedback control of A/F ratio is started at the timing tb, subsequently, the upper and lower guards α1, α2 gradually changes, i.e., gradually increases. That is, the upper and lower guards α1, α2 are restricted in rate of change. Thereby, the combustion A/F λ1 is gradually moved to the rich side, so that drivability is restricted from being deteriorated.

In this embodiment, when secondary air is supplied, the target A/F λtg is restricted in change by the lean and rich side guards λmax, λmin, so that the target A/F λtg can be properly set, similarly to the first embodiment. Additionally, when second air is supplied, the secondary air correction coefficient faf is restricted in change by the upper and lower guards α1, α2 that are set in accordance with the secondary air flow amount gsai and the target A/F λtg. Thereby, fuel can be restricted from being excessively increased. That is, the fuel injection amount TAU can be restricted from being excessively increased by correction. The upper and lower guards α1, α2 are variably set in accordance with the secondary air flow amount gsai, so that the upper and lower guards α1, α2 can be preferably set in accordance with the secondary air flow amount gsai, even when the gsai and the λtg changes. Thus, the fuel injection amount TAU can be properly corrected even when secondary air is supplied. Thus, the operating condition of the engine is stabilized, so that drivability and emission of exhaust gas can be improved.

The faf upper and lower guards gdh, gdl, which are used in the normal A/F feedback control, are corrected with the secondary air flow amount gsai and the target A/F λtg, so that the upper and lower guards α1, α2 are calculated. Thereby, robustness in the A/F control can be maintained while an excessive correction is restricted even when secondary air is supplied, similarly to the normal control, in which secondary air is not supplied.

In addition, the quick change prohibiting operation is performed to the upper and lower guards α1, α2, which are used when secondary air is supplied. Thereby, deterioration in drivability, which is caused by quick change in upper and lower guards α1, α2, can be restricted.

Third Embodiment

In this embodiment, two ranges, in which the secondary air correction coefficient faf is set, are defined to restrict the secondary air correction coefficient faf, which is used when secondary air is supplied, within the predetermined ranges. Specifically, a first faf range α1-α2 is set in accordance with the upper and lower guards, which are used in the normal A/F feedback control, in which secondary air is not supplied. Besides, a second faf range β1-β2 is set in accordance with the guard values on both rich and lean sides of the combustion A/F λ1, i.e., the A/F ratio of mixture gas flowing into the combustion chamber of the engine. Thereby, the secondary air correction coefficient faf is restricted within the first faf range α1-α2 and the second faf range β1-β2.

The upper guard α1 and the lower guard α2 are set as the first faf range α1-α2. In this situation, the faf upper and lower guards gdh, gdl, which are used in the normal A/F feedback control, are respectively corrected with correction terms, which are determined by the secondary air flow amount gsai, the intake air amount ga, and the target A/F λtg. Thereby, the upper and lower guards α1, α2 are calculated. The faf upper and lower guards gdh, gdl are used as guard values for restricting overshoots due to excessively correcting in the normal A/F ratio feedback control. The faf upper guard gdh may be defined to be 1.0+K, and the faf lower guard gdl may be defined to be 1.0−K (K>0), for example. The upper and lower guards α1, α2, which define the first faf range, are similar to the upper and lower guards α1, α2 described in the second embodiment.

The upper guard β1 and the lower guard β2 are set as the second faf range β1-β2. In this situation, the upper and lower guards β1, β2 are calculated in accordance with the rich and lean allowable combustion A/Fs λrich, λlean. The upper and lower guards α1, α2 serve as first guard values, and the upper and lower guards β1, β2 serve as second guard values.

Figure 11:
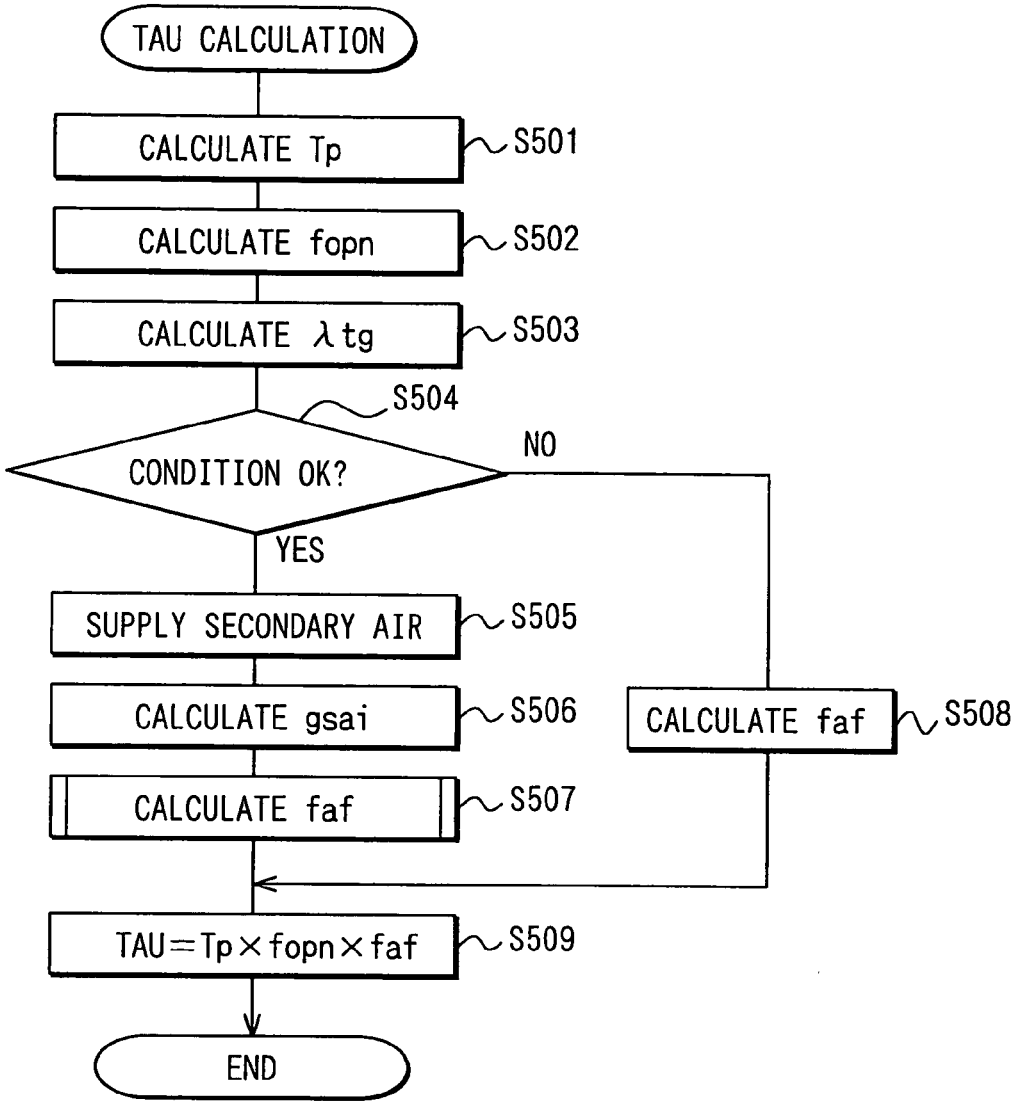
FIG. 11 is a flowchart showing a calculating routine of the amount TAU of fuel injection, according to a third embodiment of the present invention.

As shown in FIG. 11, a routine for calculating the fuel injection amount TAU is executed by the ECU 40 at a predetermined interval instead of the routine shown in FIG. 2 or the like.

In step S501, the standard fuel injection amount Tp is calculated in accordance with the parameters related to the operating conditions such as the rotation speed Ne and the intake air amount ga. The routine proceeds to S502, in which an open fuel correction coefficient fopn is calculated in accordance with an increasing amount of fuel after starting, an increasing amount of fuel in warm-up, and the like. The open fuel correction coefficient fopn is calculated in accordance with water temperature in starting, change in water temperature after starting, and the like using a table or a formula. The routine proceeds to S503, in which the target A/F λtg is calculated in accordance with the current operating condition of the engine at the time.

The routine proceeds to S504, in which it is determined whether a condition for supplying secondary air is satisfied. When the condition for supplying secondary air is satisfied, the routine proceeds to S505, in which the valve 37 is opened, and the secondary air pump 36 is operated, so that secondary air is supplied into the exhaust pipe 24. Subsequently, the routine proceeds to S506, in which the secondary air flow amount gsai is calculated in accordance with the detection signal of the pressure sensor 38 or the like.

Figure 12:
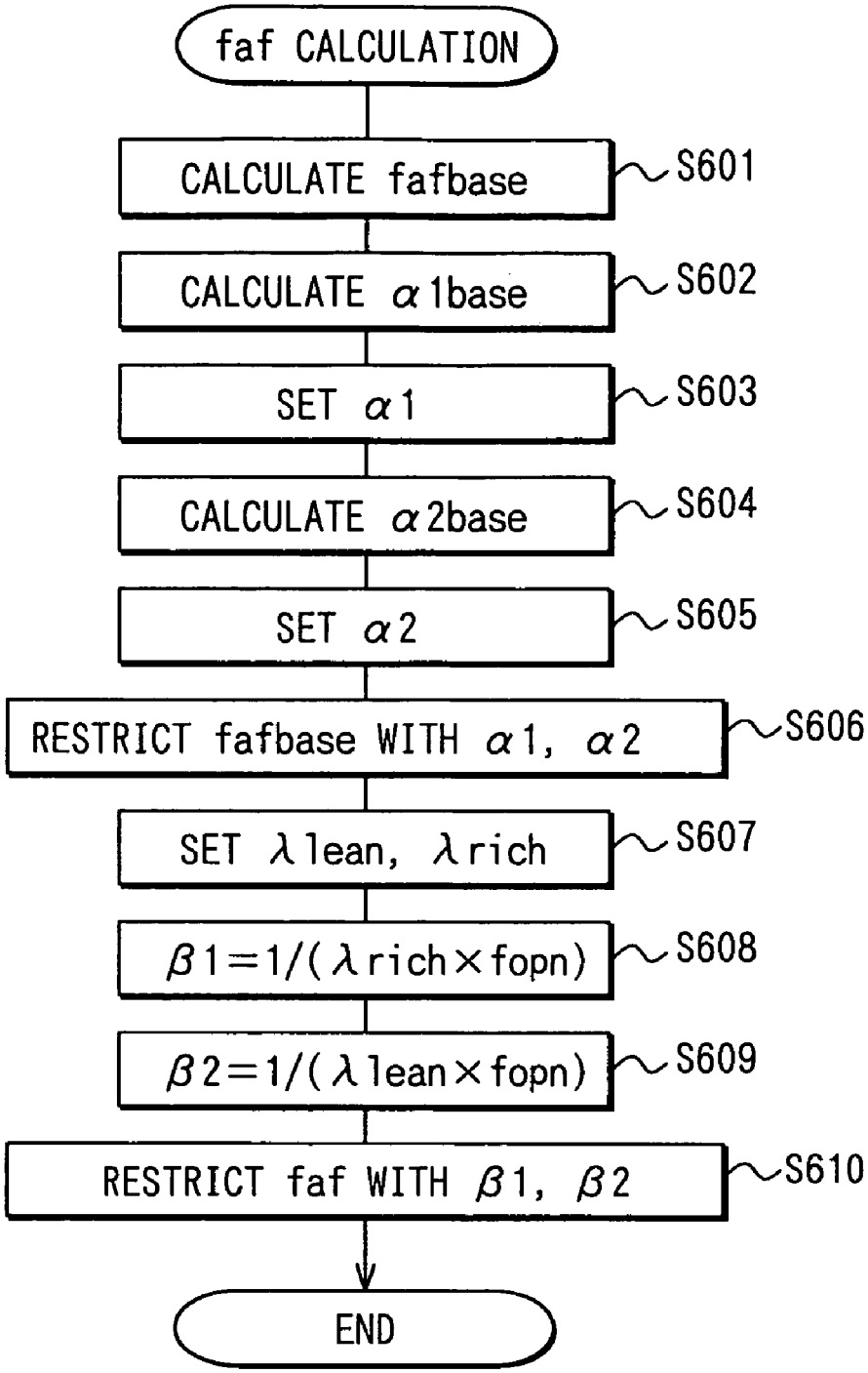
FIG. 12 is a flowchart showing a calculating routine of the air fuel ratio correction coefficient faf according to the third embodiment.

The routine proceeds to S507, in which the secondary air correction coefficient faf is calculated. That is, a faf calculation routine shown in FIG. 12 is executed. Steps S601 to S605 in the routine shown in FIG. 12 are substantially equivalent to the steps S401 to 405 of the routine shown in FIG. 8.

In S601 shown in FIG. 12, the secondary air correction coefficient base value fafbase is calculated in accordance with the current deviation between the detection A/F λdt, which is detected using the A/F sensor 32, and the target A/F λtg at the time.

Subsequently, the routine proceeds to S602, S603, in which the faf upper guard α1 is calculated. Specifically, the upper guard base value λ1base is calculated in accordance with the faf upper guard gdh, which is used when secondary air is not supplied in the normal control, the secondary air flow amount gsai, the intake air amount ga, and the target A/F λtg using the formula (5). Besides, the quick change prohibiting operation is performed to the upper guard base value (1base using the formula (6), so that the solution of the formula (6) is set as the faf upper guard α1.

The routine proceeds to S604, S605, in which the faf lower guard α2 is calculated. Specifically, the lower guard base value α2base is calculated in accordance with the faf lower guard gdl, which is used in the normal condition, the secondary air flow amount gsai, the intake air amount ga, and the target A/F λtg using the formula (7). Besides, the quick change prohibiting operation is performed to the lower guard base value α2base using the formula (8), so that the solution of the formula (8) is set as the faf lower guard α2.

The routine proceeds to S606, in which the secondary air correction coefficient base value fafbase is guarded by the upper and lower guards α1, α2, so that the secondary air correction coefficient faf is calculated. In this situation, when a relationship α2<fafbase<α1 is satisfied, faf is set to be fafbase. Besides, when a relationship fafbase≦α2 is satisfied, faf is set to be α2. Besides, when a relationship fafbase≧α1 is satisfied, faf is set to be α1.

The routine proceeds to S607 to S609, in which the second faf upper guard β1 and the second faf lower guard β2 are calculated in accordance with the allowable combustion A/F ratio of the engine. Specifically, in S607, the lean and rich allowable combustion A/Fs λlean, λrich are set. The allowable combustion A/Fs λlean, λrich may be set in accordance with the cooling water temperature WT and the time elapsed after starting the engine, for example, and specifically, may be set in accordance with the relationship shown in FIG. 4. In S608, the second faf upper guard β1 is calculated based on the rich allowable combustion A/F λrich and the open fuel correction coefficient fopn using a formula (9).

$$\beta 1=1/(\lambda rich\times fopn) \quad (9)$$

In S609, the second faf lower guard β2 is calculated based on the lean allowable combustion A/F λlean and the open fuel correction coefficient fopn using a formula (10).

$$\beta 2=1/(\lambda lean\times fopn) \quad (10)$$

In S610, the secondary air correction coefficient fat, which is calculated in S606, is guarded by the second faf upper and lower guards β1, β2, so that the secondary air correction coefficient faf is finally calculated. In this situation, when the secondary air correction coefficient faf is equal to or greater than the second faf upper guard β1, the faf is guarded by the β1, and when the secondary air correction coefficient faf is equal to or less than the second faf lower guard β2, the faf is guarded by the β2.

As referred to FIG. 11, when the condition for supplying secondary air is not satisfied in S504, the routine proceeds to S508, in which the secondary air correction coefficient faf is calculated in accordance with the current deviation between the detection A/F λdt and the target A/F λtg at the time. The operation in S508 is performed in the normal control.

After the secondary air correction coefficient faf is calculated in S507, S508, the routine proceeds to S509, in which the standard fuel injection amount Tp is multiplied with the open fuel correction coefficient fopn and the secondary air correction coefficient faf, so that the product calculated in S509 is set as the fuel injection amount TAU, that is, TAU=Tp×fopn×faf.

Figure 13:
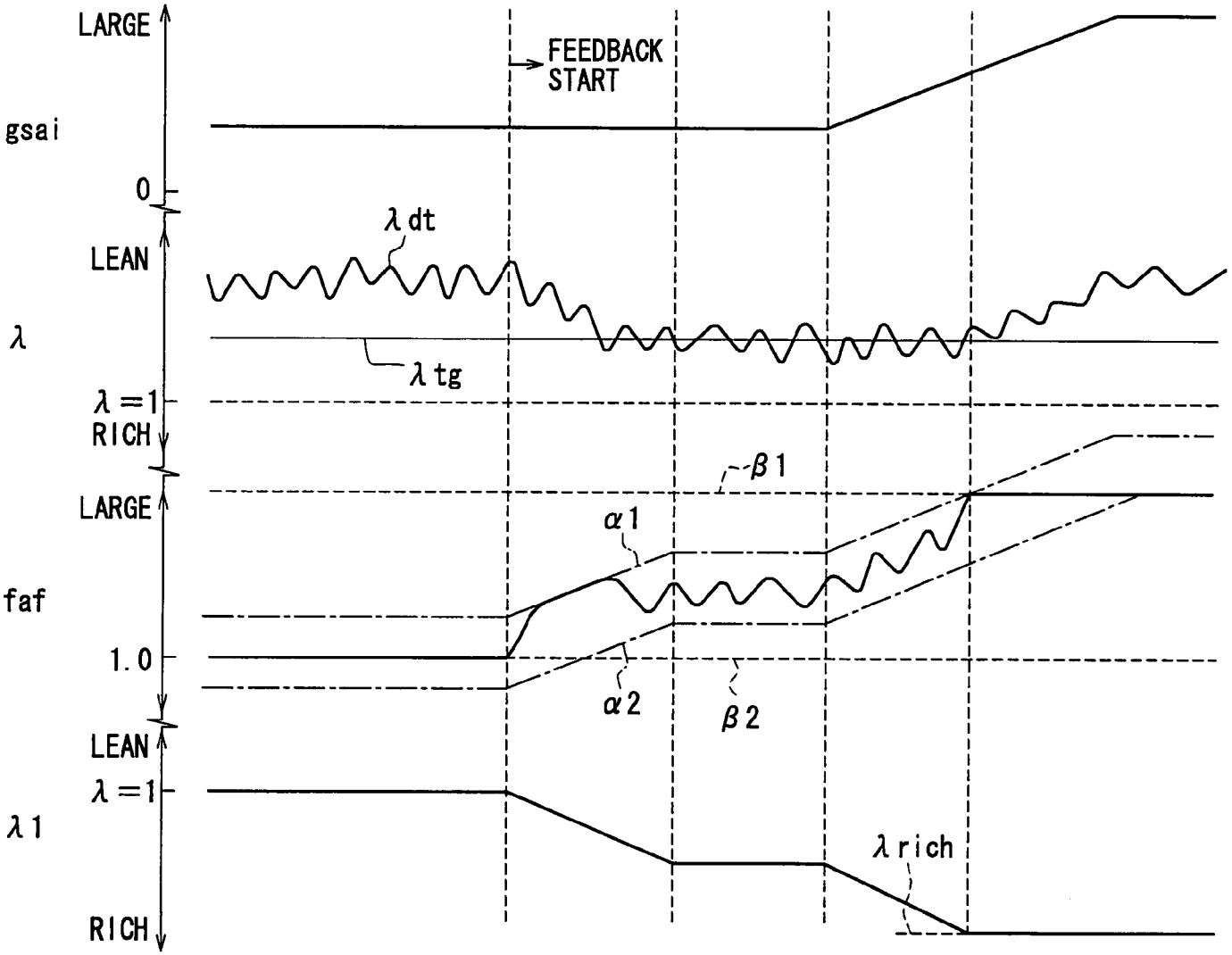
FIG. 13 is a time chart showing behaviors of parameters when secondary air is supplied, according to the third embodiment.

As shown in FIG. 13, the A/F feedback control is started at t21, and subsequently, the secondary air flow amount gsai is increased at t23. The upper and lower guards α1, α2 are shown by dashed lines to define the first faf range α1-α2, and the second faf upper and lower guards β1, β2 are shown by dotted lines to define the second faf range β1-β2 in the time chart showing a behavior of the secondary air correction coefficient faf. The intake air amount ga is constant.

When the A/F feedback control is started at t21, the secondary air correction coefficient faf is calculated to eliminate deviation between the detection A/F λdt and the target A/F λtg. In this situation, the detection A/F λdt is on the lean side relative to the target A/F λtg, so that the secondary air orrection coefficient faf is increased. Besides, the upper and lower guards α1, α2, which define the first faf range α1-α2, are set corresponding to the current secondary air flow amount gsai at the time, so that the secondary air correction coefficient faf changes while the faf is guarded within the first faf range α1-α2.

At t22, the upper and lower guards α1, α2 once converges, however in the period after t23, the upper and lower guards α1, α2 increase, as the secondary air flow amount gsai increases. At t24, the upper guard α1, which defines the first faf range α1-α2, exceeds the second faf upper guard β1, which defines the second faf range β1-β2, so that the secondary air correction coefficient faf is guarded by the second faf upper guard β1.

The combustion A/F λ1 is restricted from being changed to the rich side by the rich allowable combustion A/F λrich in the period after t24. The secondary air correction coefficient faf and the combustion A/F λ1 are restricted as described above in the period after t24, so that drivability and emission of exhaust gas can be restricted from being deteriorated.

In this embodiment, the first and second faf ranges α1-α2, β1-β2 are set when secondary air is supplied, so that the secondary air correction coefficient faf is restricted within the faf ranges α1-α2, β1-β2. In this case, the secondary air correction coefficient faf can be preferably controlled in view of conditions such as a condition, in which secondary air is supplied, and a combustion condition of the engine. Thus, the fuel injection amount TAU can be preferably corrected even when secondary air is supplied, so that the operating condition of the engine is stabilized. Thereby, drivability and emission of exhaust gas can be improved.

Fourth Embodiment

In this embodiment, the secondary air correction coefficient fsai and the secondary air correction coefficient faf are used as correction coefficients for correcting the fuel injection amount TAU when secondary air is supplied.

Figure 15:
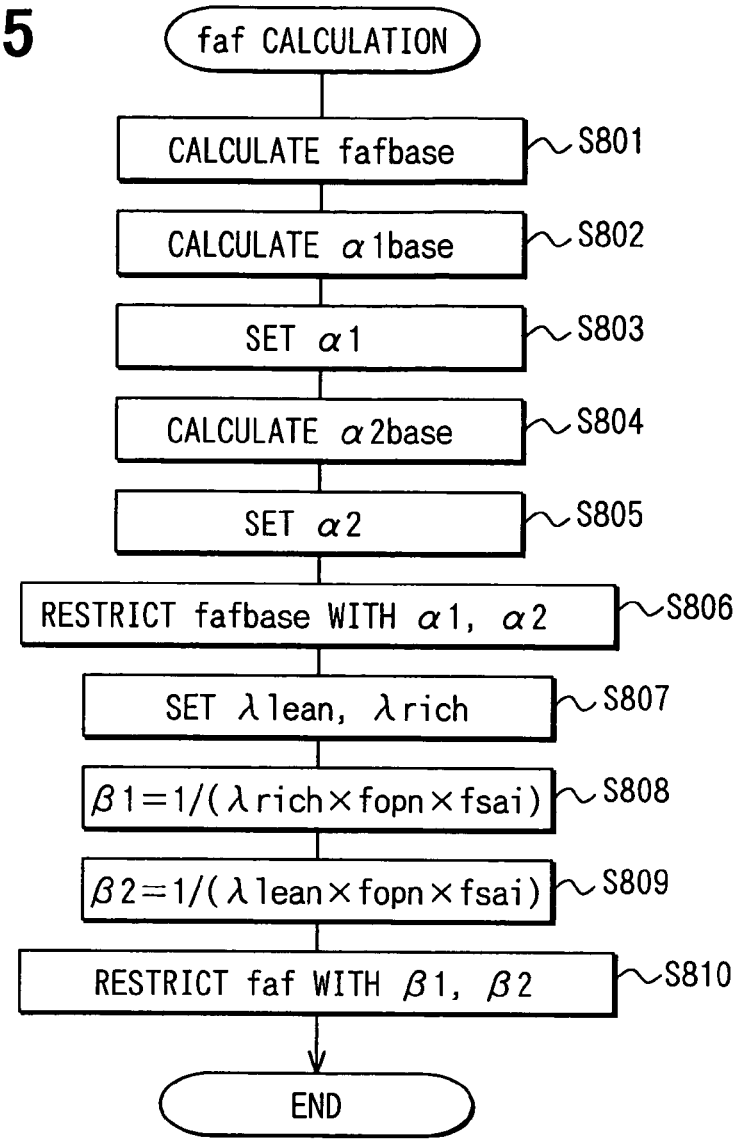
FIG. 15 is a flowchart showing a calculating routine of the air fuel ratio correction coefficient faf according to the fourth embodiment.

As shown in FIG. 15, a routine for calculating the fuel injection amount TAU is executed by the ECU 40 at a predetermined interval instead of the routine shown in FIG. 11.

In steps S701 to S703, the standard fuel injection amount Tp, the open fuel correction coefficient fopn, and the target A/F λtg are calculated. The routine proceeds to S705, 706, in which the valve 37 is opened, and the secondary air pump 36 is operated, so that secondary air is supplied, when a condition for supplying secondary air is satisfied. Besides, the secondary air flow amount gsai is calculated in accordance with the detection signal of the pressure sensor 38 or the like.

Figure 16:
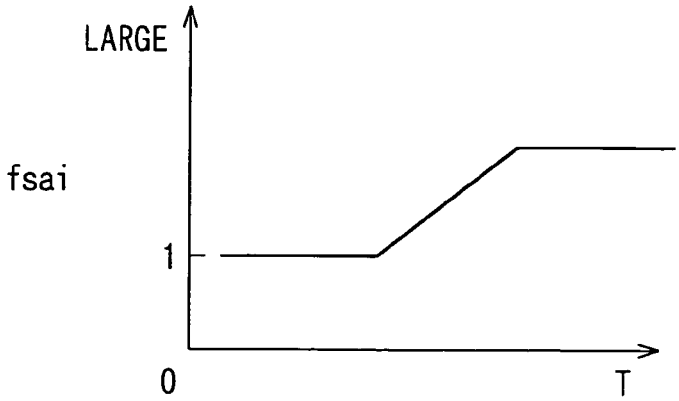
FIG. 16 is a graph showing a relationship between time T elapsed after an engine starts and a correction coefficient fsai for secondary air according to the fourth embodiment.

The routine proceeds to S707, in which the secondary air correction coefficient fsai is calculated using a relationship shown in FIG. 16 in accordance with the time T elapsed after starting the engine.

The routine proceeds to S708, in which the secondary air correction coefficient faf is calculated using a routine for calculating faf shown in FIG. 15. Steps S808, S810 of the routine shown in FIG. 15 is different from the routine shown in FIG. 12.

In S801, the secondary air correction coefficient base value fafbase is calculated based on the deviation between A/Fs λdt, λtg. In S802 to S806, the faf upper and lower guards α1, α2 are calculated similarly to steps S602 to S606 in FIG. 12. Specifically, the upper guard base value α1base is calculated using the formula (5), and the quick change prohibiting operation is performed to the α1 base using the formula (6), so that the solution of the formula (6) is set as the faf upper guard α1. Besides, the lower guard base value α2base is calculated using the formula (7). The quick change prohibiting operation is performed to the lower guard base value α2base using the formula (8), so that the solution of the formula (8) is set as the faf lower guard α2. The secondary air correction coefficient base value fafbase is guarded by the upper and lower guards α1, α2.

The routine proceeds to steps S807 to S809, in which the second faf upper and lower guards β1, β2 of the second faf range β1-β2 are calculated based on the allowable combustion A/F ratios of the engine. Specifically, in S807, the rich and lean allowable combustion A/Fs λrich, λlean are set similarly to S607 in FIG. 12. In S808, the second faf upper guard β1 is calculated based on the rich allowable combustion A/F λrich, the open fuel correction coefficient fopn, and the secondary air correction coefficient fsai using a formula (11).

$$\beta 1=1(\lambda rich\times fopn\times fsai) \quad (11)$$

In S809, the second faf lower guard β2 is calculated based on the lean allowable combustion A/F λlean, the open fuel correction coefficient fopn, and the secondary air correction coefficient fsai using a formula (12).

$$\beta 2=1(\lambda lean \times fopn \times fsai) \quad (12)$$

In S810, the secondary air correction coefficient faf, which is calculated in S806, is guarded by the second faf upper and lower guards β1, β2, so that the secondary air correction coefficient faf is finally calculated. In this situation, when the faf is equal to or greater than the second faf upper guard β1, the faf is guarded by the β1, and when the faf is equal to or less than the second faf lower guard β2, the faf is guarded by the β2.

Figure 14:
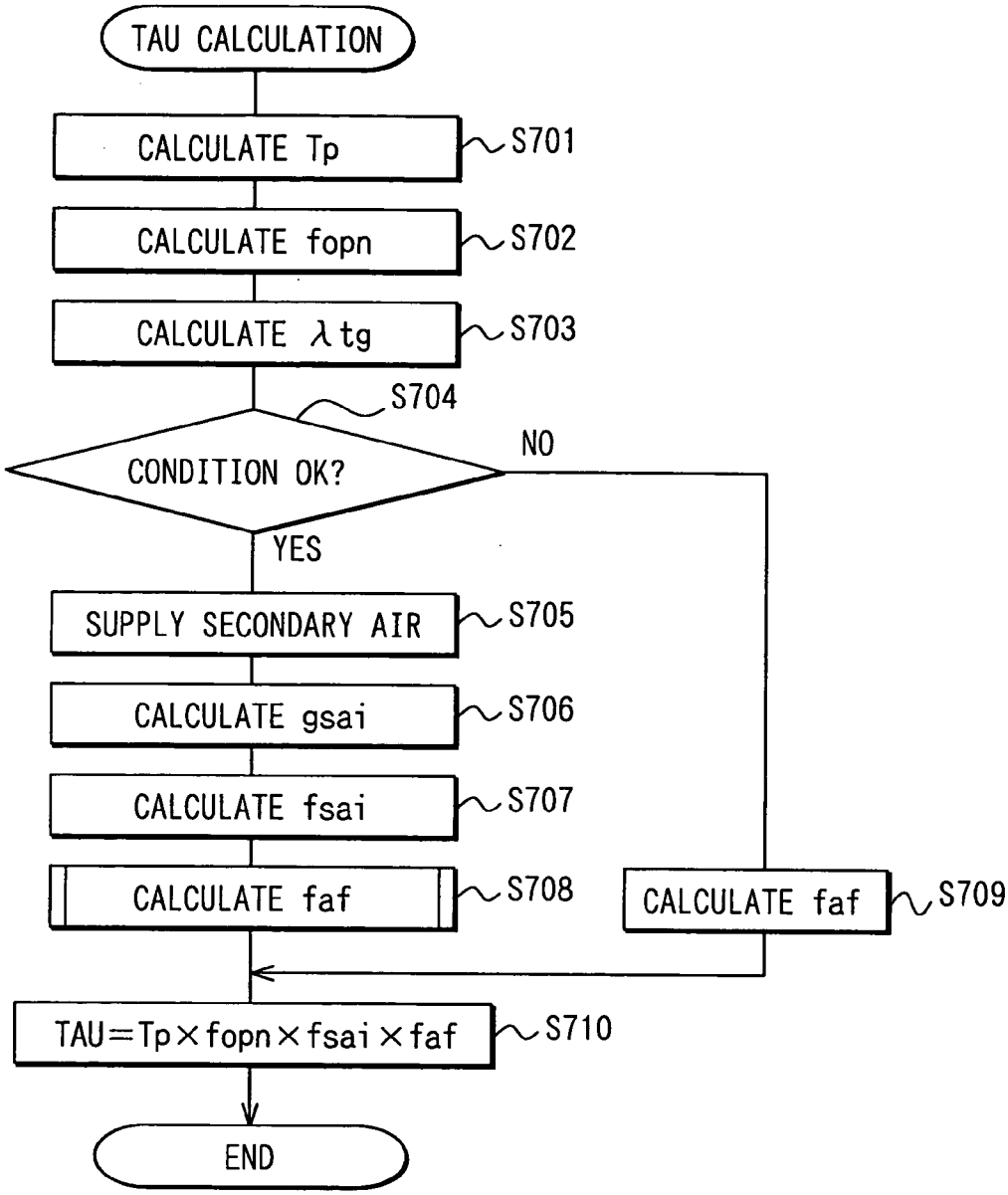
FIG. 14 is a flowchart showing a calculating routine of the amount TAU of fuel injection, according to a fourth embodiment of the present invention.

As referred to FIG. 14, when the condition for supplying secondary air is not satisfied in S704, the routine proceeds to 709, in which the secondary air correction coefficient faf is calculated in accordance with the deviation between the A/Fs λdt and λtg. The operation in S709 is performed in the normal control.

After the secondary air correction coefficient faf is calculated in S708, S709, the routine proceeds to S710, in which the standard fuel injection amount Tp is multiplied with the open fuel correction coefficient fopn, secondary air correction coefficient fsai, and the secondary air correction coefficient faf, so that the product calculated in S710 is set as the fuel injection amount TAU, that is, TAU=Tp×fopn×fsai×faf.

Figure 17:
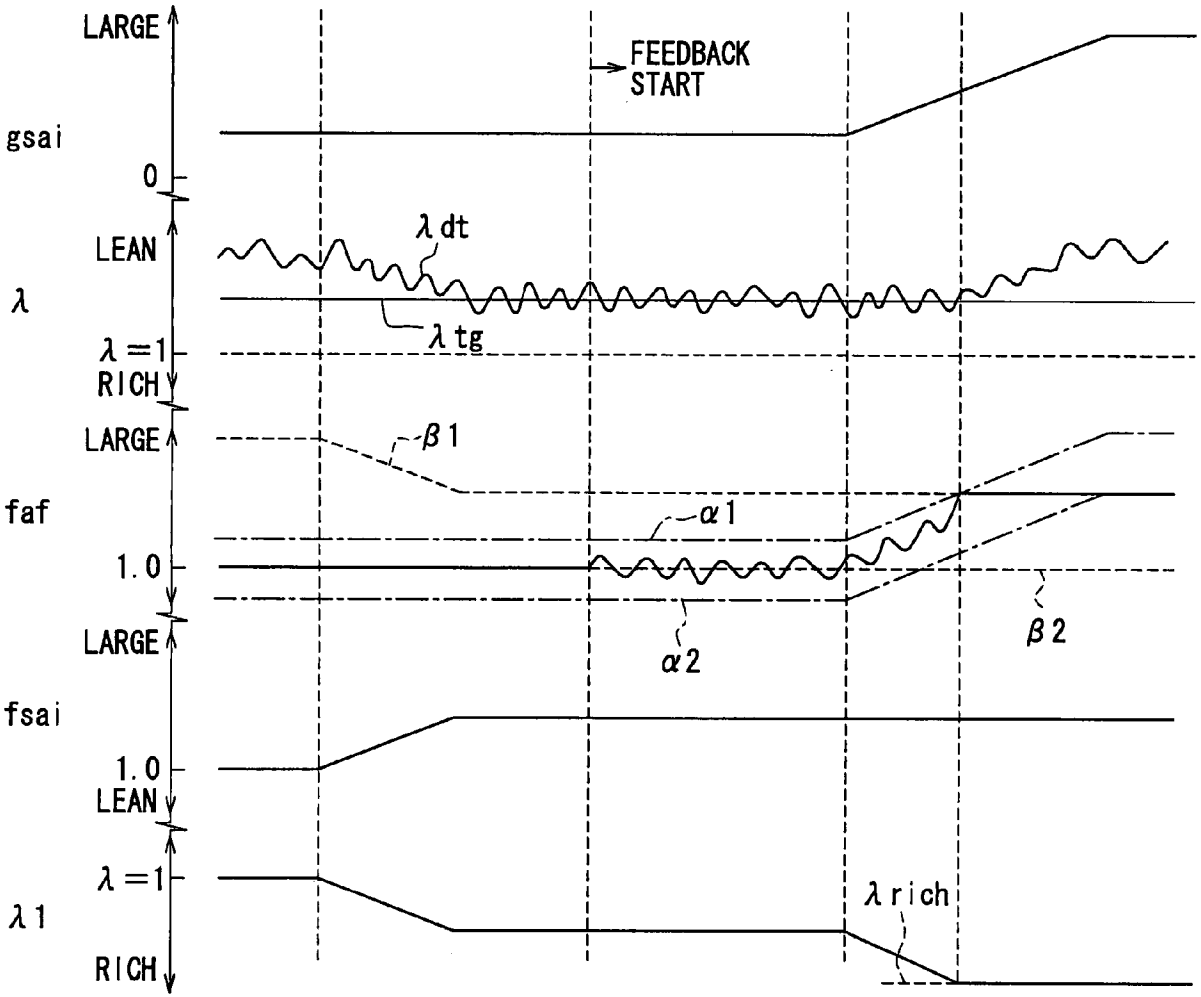
FIG. 17 is a time chart showing behaviors of parameters when secondary air is supplied, according to the fourth embodiment.

As shown in FIG. 17, the A/F feedback control is started at t32, and subsequently, the secondary air flow amount gsai is increased at t33. The upper and lower guards α1, α2 are shown by dashed lines to define the first faf range α1-α2, and the second faf upper and lower guards β1, β2 are shown by dotted lines to define the second faf range β1-β2 in the time chart showing a behavior of the secondary air correction coefficient faf. The intake air amount ga is constant.

The secondary air correction coefficient fsai increases in the period after t31. As the fsai increases, the upper guard β1, which defines the second faf range β1-β2, decreases.

When the A/F feedback control is started at t32, the secondary air correction coefficient faf is calculated to eliminate deviation between the detection A/F λdt and the target A/F λtg. In this situation, the fuel injection amount TAU is already increased by the secondary air correction coefficient fsai, so that the detection A/F λdt converges in the vicinity of the target A/F λtg. Therefore, the secondary air correction coefficient faf does not largely change. Besides, the upper and lower guards α1, α2, which define the first faf range α1-α2, are maintained substantially constant from the period before the feedback control is started.

At t33, as the secondary air flow amount gsai increases, the upper and lower guards α1, α2 also increases. At t34, the upper guard α1, which defines the first faf range α1-α2, exceeds the second faf upper guard β1, which defines the second faf range β1-β2, so that the secondary air correction coefficient faf is guarded by the second faf upper guard β1.

The combustion A/F λ1 is restricted from being changed to the rich side by the rich allowable combustion A/F λrich in the period after t34. The secondary air correction coefficient faf and the combustion A/F λ1 are restricted as described above in the period after t34, so that drivability and emission of exhaust gas can be restricted from being deteriorated.

In this embodiment, the first and second faf ranges α1-α2, β1-β2 are set when secondary air is supplied, so that the secondary air correction coefficient faf is restricted within the faf ranges α1-α2, β1-β2, similarly to the third embodiment. Therefore, the secondary air correction coefficient faf can be preferably controlled in view of conditions such as a condition, in which secondary air is supplied, and a combustion condition of the engine. Thus, the fuel injection amount TAU can be preferably corrected even when secondary air is supplied, so that the operating condition of the engine is stabilized. Thereby, drivability and emission of exhaust gas can be improved.

Fifth Embodiment

Figure 20:
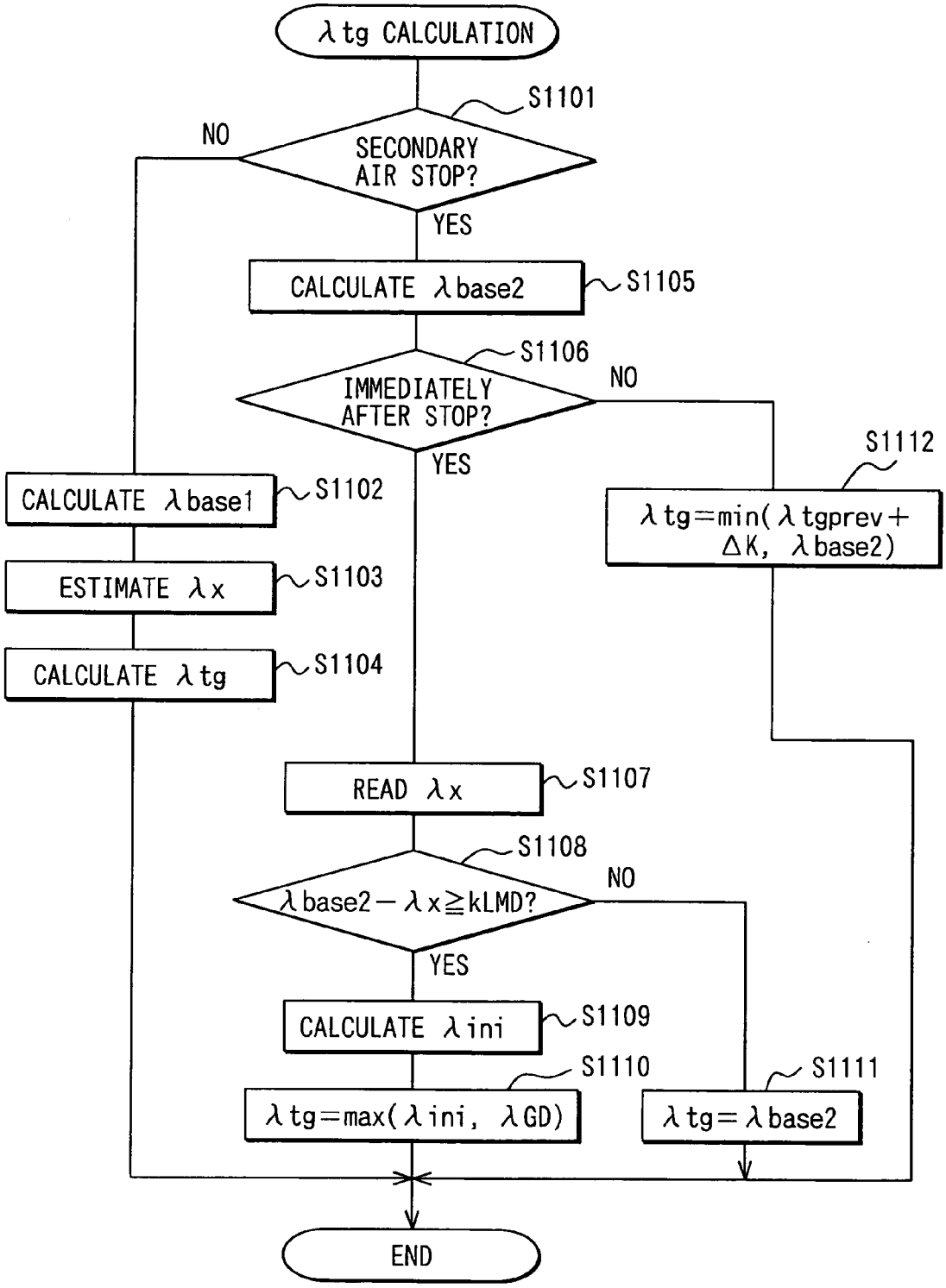
FIG. 20 is a flowchart showing a calculating routine of the target air fuel ratio λtg according to a fifth embodiment of the present invention.

As shown in FIG. 20, a routine for calculating the target A/F λtg is executed by the ECU 40 at a predetermined interval.

In S1101, it is determined whether secondary air is stopped at the time. When secondary air is supplied, the routine proceeds to S1102, in which a target A/F base value λbase1, which his used when secondary air is supplied, is calculated. In this situation, the target A/F base value λbase1 is calculated in accordance with the current rotation speed Ne and current load at the time using a target A/F ratio data map for the condition, in which secondary air is supplied, for example. The target A/F base value λbase1 is set such that emission of exhaust gas when secondary air is supplied becomes in a preferable condition. For example, the target A/F base value λbase1 is set to be 1.05. The target A/F base value λbase1 serves as a first target value.

The routine proceeds to S1103, in which a combustion A/F λx of the engine when secondary air is supplied is estimated. The combustion A/F λx is an air fuel ratio of mixture gas supplied into the engine.

In S1104, the target A/F λtg is calculated. In this situation, a guard operation or the like is preferably performed to the target A/F base value λbase1, which is calculated in S1102, in accordance with the secondary air flow amount or the like, so that the target A/F λtg may be calculated. Here, the target A/F λtg is set to be the target A/F base value λbase1.

When secondary air is determined to be stopped in S1101, the routine proceeds to S1105, in which a target A/F base value λbase2, which is used when secondary air is stopped, is calculated. In this situation, the target A/F base value λbase2 is calculated in accordance with the current rotation speed Ne and current load at the time using a target A/F ratio data map for the condition, in which secondary air is stopped, for example. The target A/F base value λbase2 is set such that emission of exhaust gas when secondary air is stopped becomes in a preferable condition. For example, the target A/F base value λbase2 is set to be 1.0, i.e., to be in the stoichiometric condition. The target A/F base value λbase2 serves as a second target value.

In S1106, a present condition is determined whether it is immediately after stopping secondary air. When it is determined to be immediately after stopping secondary air in S1106, the routine proceeds to S1107, in which the combustion A/F λx, which is estimated when secondary air is supplied, is read. Specifically, the combustion A/F λx is estimated immediately before switching from the condition, in which secondary air is supplied, to the condition, in which secondary air is stopped.

In S1108, it is determined whether a difference between the target A/F base value λbase2 and the combustion A/F λx is equal to or greater than a predetermined threshold kLMD. When the relationship λbase2−λx≧kLMD is satisfied, the routine proceeds to S1109, in which an initial target value λini is calculated for initially setting the target A/F ratio immediately after stopping secondary air, using a formula (13).

$$\lambda ini = \lambda x \times \frac{ga + gsai}{ga} \quad (13)$$

Here, the secondary air flow amount gsai is 0, so that the initial target value λini is set to be the combustion A/F λx.

In S1110, the target A/F λtg is set to be one of the initial target value λini and an A/F guard value λGD, which is larger than the other one of the λini and the λGD. The A/F guard value λGD is set to be a predetermined rich value such that emission of exhaust gas is maintained within an allowable level. In S1110, the target A/F λtg is restricted from being set on the rich side relative to the A/F guard value λGD.

When the relationship λbase2−λx<kLMD is satisfied in S1108, the routine proceeds to S1111, in which the target A/F λtg is set to be the target A/F base value λbase2. That is, in a condition, in which λbase2−λx≧kLMD, the target A/F λtg is initially set by the initial target value λini or the like on the rich side. By contrast, in a condition, in which λbase2−λx<kLMD, the target A/F λtg is initially set by the target A/F base value λbase2.

In addition, when the secondary air is stopped, however, it is not immediately after stopping secondary air, the routine proceeds to S1112, in which the target A/F λtg is calculated. Specifically, a predetermined value ΔK is added to a previous value of the target A/F (previous target A/F) λtgprev, so that A/F λtgprev+ΔK is calculated. Subsequently, A/F λtgprev+ΔK is compared with the target A/F base value λbase2, so that one of the A/F λtgprev +ΔK and λbase2, which is smaller than the other of the A/F λtgprev +ΔK and λbase2 is set to be the target A/F λtg, which is a present value of the target A/F ratio. The operation, in which the target A/F λtg is set to be the A/F λtgprev+ΔK in S1112, serves as a gradually changing operation of the target A/F ratio. When the target A/F λtg once becomes the target A/F base value λbase2, the target A/F λtg may be set to be the target A/F base value λbase2 every time.

Figure 21:
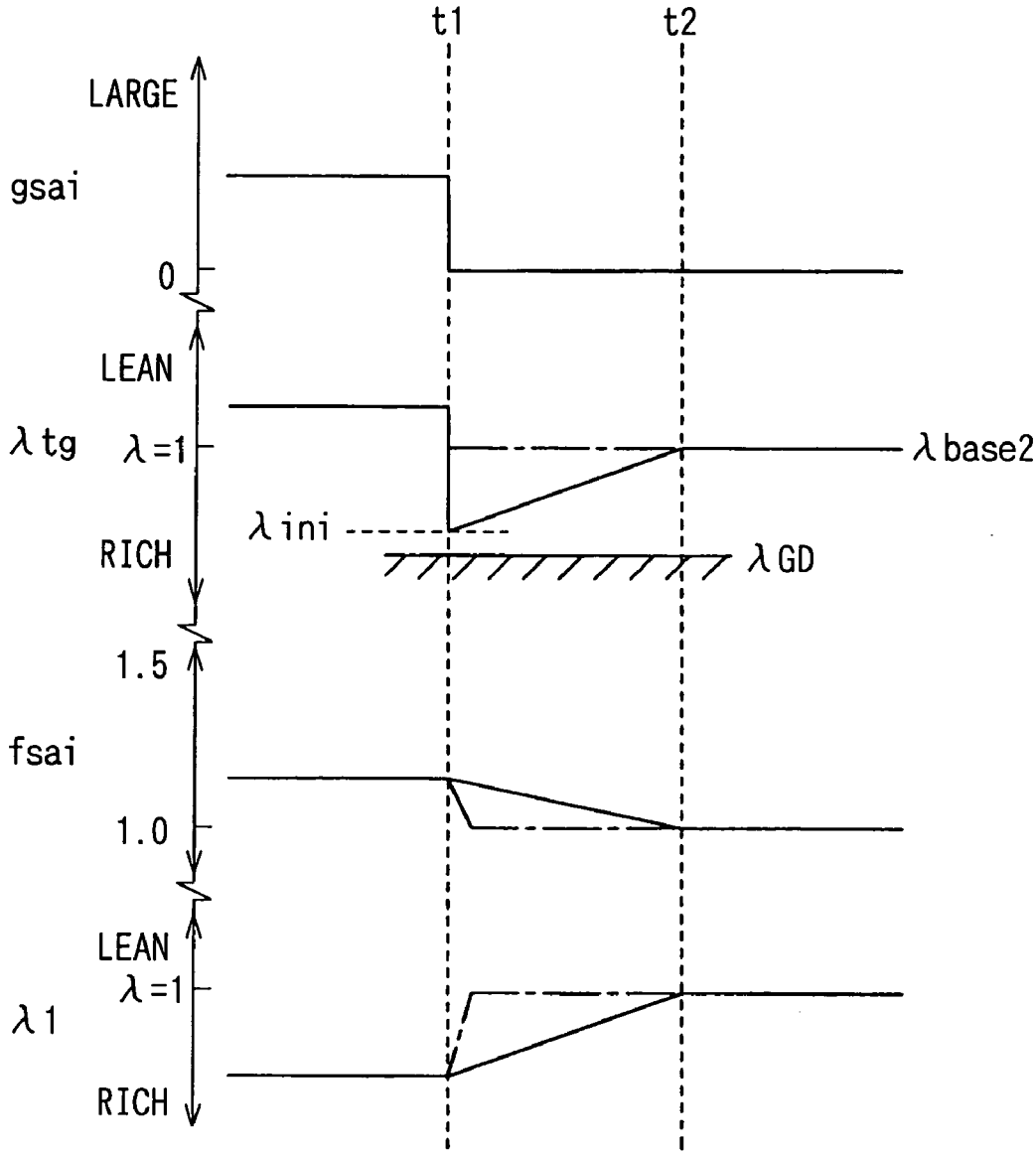
FIG. 21 is a time chart showing behaviors of parameters when secondary air is supplied, according to the fifth embodiment.

As shown in FIG. 21, secondary air, which is supplied, is stopped at t1. Here, conventional behaviors are shown by dashed lines in charts showing behaviors of the target A/F λtg, the secondary air correction coefficient fsai, and the combustion A/F λ1.

Secondary air is supplied in the period before t1, so that the secondary air flow amount gsai is set at a predetermined value, and the target A/F λtg is set at a predetermined value on the relatively lean side, e.g., the target A/F base value λbase1. In this situation, the secondary air correction coefficient fsai is greater than 1.0, and the combustion A/F λ1 is less than 1.

When secondary air is stopped at t1, the secondary air flow amount gsai becomes 0, and the target A/F λtg is changed to the rich side. In this situation, in the conventional control shown by the dashed liens, the target A/F λtg is directly changed to the target A/F base value λbase2. Accordingly, the secondary air correction coefficient fsai and combustion A/F λ1 are quickly changed. As a result, drivability may be deteriorated.

On the contrary, in this embodiment, the target A/F λtg is once changed to be the initial target value mini on the rich side of the target A/F base value λbase2. Subsequently, the target A/F λtg is gradually changed to the target A/F base value λbase2. Thereby, the secondary air correction coefficient fsai and the combustion A/F λ1 can be restricted from being quickly changed, so that drivability can be restricted from being deteriorated. Specifically, in this embodiment, the initial target value λini is equal to the combustion A/F λx, which is the A/F ratio immediately before stopping secondary air, so that when secondary air is stopped, the previous fuel combustion condition is continued, so that the operation can be smoothly changed. The target A/F λtg converges to the target A/F base value λbase2 at the timing t2.

In this embodiment, when secondary air is stopped, the target A/F λtg is initially set on the rich side relative to the target A/F base value λbase2, which is after stopping secondary air. Subsequently, the target A/F λtg is gradually changed to the target A/F base value λbase2, so that the combustion A/F λ1 can be restricted from being quickly changed, and drivability can be improved.

The A/F guard value λGD is set to maintain emission of exhaust gas within the allowable level, so that drivability can be restricted from being deteriorated when secondary air is stopped, and emission of exhaust gas can be steadily restricted from being deteriorated.

This embodiment of the present invention is not limited to the above operations. The target A/F λtg may be gradually changed to the target A/F base value λbase2 after the control condition, in which the initial target value λini is set, is maintained for a predetermined period when secondary air is stopped.

In this embodiment, the target A/F base1 value λbase is set on the lean side, e.g., λbase1=1.05 when secondary air is supplied, so that the fuel injection amount is controlled. However, the target A/F base value λbase1 may be set at the stoichiometric side, i.e., λbase1=1.0.

The secondary air correction coefficient faf can be calculated in accordance with a deviation between the detection A/F λdt detected using the A/F sensor 32 and the target A/F λtg, and the fuel injection amount TAU can be corrected based on the secondary air correction coefficient faf. Here, the secondary air correction coefficient faf is calculated by multiplying the feedback gain with the deviation between the detection A/F λdt and the target A/F λtg, in general.

The fuel injection amount TAU can be corrected using the secondary air correction coefficient fsai and the secondary air correction coefficient faf. In this case, the fuel injection amount TAU can be calculated using a formula (14).

$$TAU = Tp \times fsai \times faf \quad (14)$$

The operations of the present invention are not limited to the above embodiments.

In the first embodiment and the like, when secondary air is supplied, the lean and rich side guards λmax, λmin are set in accordance with change in secondary air flow amount gsai for restricting excessive change in combustion A/F rate and the like caused by change in secondary air flow amount.

However, this operation can be changed. For example, change in secondary air flow amount gsai with respect to the intake air amount ga is set as a secondary air parameter, which is shown by ((ga+gsai)/ga). Besides, when secondary air is supplied, it is determined whether the secondary air parameter is within a predetermined range γ1-γ2(γ1<γ2). When the secondary air parameter is within a predetermined range γ1-γ2, the target A/F λtg is set to be the target A/F base value λbase. By contrast, when the secondary air parameter is less than the γ1 due to decrease in secondary air flow amount gsai, the target A/F λtg is changed to the rich side relative to the target A/F base value λbase. Besides, when the secondary air parameter is greater than the γ2 due to increase in secondary air flow amount gsai, the target A/F λtg is changed to the lean side relative to the target A/F base value λbase. In this case, the target A/F λtg may be changed to be proportional relative to change in secondary air parameter. Even in this operation, the fuel injection amount TAU can be preferably corrected even when secondary air is supplied similarly to the above embodiments, so that drivability and emission of exhaust gas can be improved.

Only the rich side guard λmin may be set as the guard value for restricting the target A/F λtg.

Only the upper guards α1, β1 may be set as the guard value for restricting the secondary air correction coefficient faf.

Figure 4:
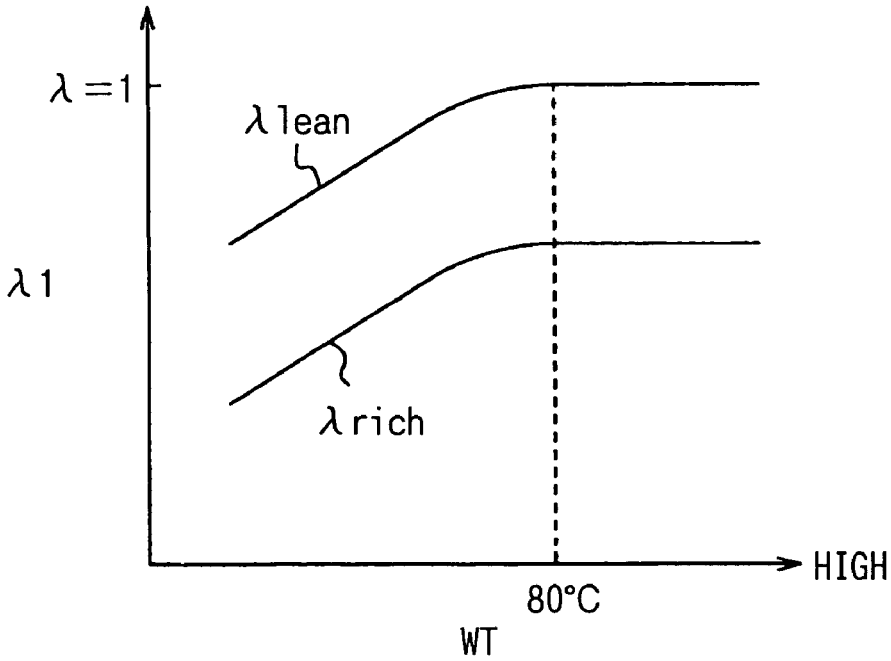
FIG. 4 is a graph showing a relationship between water temperature WT and allowable combustion air fuel ratios λlean and λrich according to the first embodiment.

In the above embodiments, the rich and lean allowable combustion A/Fs λrich, λlean are calculated using the relationship shown in FIG. 4 based on the water temperature WT of the engine. However, a correction can be performed in this calculation using a correcting parameter. As the correcting parameter, following factors can be included such as load (the intake air amount, an air amount filled in the cylinder, pressure in the intake pipe), ignition timing, water temperature when the engine is started, time elapsed after the engine is started, valve timing of the intake valve and the exhaust valve, valve lift of the intake valve and the exhaust valve, an amount of EGR, a condition of vortex flow such as tumble, swirl, a property of fuel, outside air temperature, intake air temperature, fuel temperature, atmospheric pressure.

In the fourth embodiments, the secondary air correction coefficient fsai is calculated using the relationship shown in FIG. 16 based on the time elapsed after the engine is started. However, a correction can be performed in this calculation using a correcting parameter. As the correcting parameter, following factors can be included such as water temperature when the engine is started, water temperature, load (the intake air amount, an air amount filled in the cylinder, pressure in the intake pipe), an open fuel correction coefficient, ignition timing, temperature of catalyst, a period while the engine is stopped, outside air temperature, intake air temperature, the secondary air flow amount.

In the A/F feedback control, when the secondary air flow amount changes, or pulsation arises in exhaust gas due to secondary combustion in the exhaust pipe 24, secondary air cannot be stably supplied. As a result, a detection signal of the A/F ratio may be unstable, and the A/F feedback control may be deteriorated in accuracy. Therefore, the feedback gain may be variably set in accordance with the secondary air flow amount and pulsation in exhaust gas. Specifically, an influence of pulsation in exhaust gas is estimated based on the current engine operating condition at the time, subsequently, the feedback gain is set in accordance with the estimation result. In this situation, influence of pulsation in exhaust gas varies corresponding to the amplitude and the cycle. Therefore, as shown in FIG. 18A, the influence of the pulsation in exhaust gas may be estimated in accordance with the rotation speed Ne of the engine and load. According to the relationship shown in FIG. 18A, as the amplitude becomes large, i.e., as the load becomes large, the influence of the pulsation in exhaust gas is estimated to be large. However, even when the amplitude is large, when the cycle is short, i.e., when the rotation speed Ne of the engine is high, the amplitude is canceled, so that the influence of the pulsation in exhaust gas is estimated to be small. Additionally, as shown in FIG. 18B, as the influence of the pulsation in exhaust gas becomes large, the feedback gain is set small. By contrast, as the influence of the pulsation in exhaust gas becomes small, the feedback gain is set large.

Alternatively, as shown in FIG. 19, as the secondary air flow amount gsai becomes large, the feedback gain may be set low. By contrast, as the secondary air flow amount gsai becomes small, the feedback gain may be set high. Thus, even when the secondary air flow amount gsai changes, or pulsation arises in exhaust gas, hunting or the like can be restricted in control.

In the above embodiments, the target A/F base value λbase is set on the lean side, e.g., λbase=1.05 when secondary air is supplied, so that the fuel injection amount is controlled. However, the target A/F base value λbase may be set at the stoichiometric side, i.e., λbase=1.0.

In the above embodiments, the secondary air flow amount is calculated in accordance with the differential pressure between the secondary air pressure and shutoff pressure, i.e., standard pressure. However, instead of the above operation, the secondary air flow amount may be calculated in accordance with the differential pressure between the secondary air pressure and exhaust gas pressure in the exhaust pipe. In this case, the secondary air flow amount is calculated in accordance with not only the secondary air pressure but also the exhaust gas pressure. Thereby, the secondary air flow amount can be accurately calculated, even when exhaust gas pressure changes due to change in engine operating condition. Thus, accuracy in control of the fuel injection amount can be improved.

The structures, functions, and operations of the above embodiments can be combined as appropriate.

Various modifications and alternations may be diversely made to the above embodiments without departing from the spirit of the present invention.

What is claimed is:

1. A fuel injection amount control device for an internal combustion engine, the fuel injection amount control device comprising:

a secondary air supply device that supplies secondary air into an exhaust passage of the internal combustion engine;

flow amount calculating means that calculates a secondary air flow amount, the secondary air flowing into the exhaust passage;

target air fuel ratio setting means that sets a target air fuel ratio when secondary air is supplied;

fuel amount correcting means that corrects a fuel injection amount in accordance with a current value of the secondary air flow amount such that the air fuel ratio on a downstream side of an inlet of secondary air in the exhaust passage becomes the target air fuel ratio when secondary air is supplied;

target changing means that monitors increase and decrease in the secondary air flow amount, the target changing means changing the target air fuel ratio to one of a rich side and a lean side in accordance with the increase and decrease in the secondary air flow amount;

means for setting a guard value of the target air fuel ratio on at least the rich side in accordance with the secondary air flow amount calculated using the flow amount calculating means, and wherein the target changing means restricts the target air fuel ratio with the guard value when the target air fuel ratio reaches the guard value.

2. The fuel injection amount control device according to claim 1, wherein the target changing means changes the target air fuel ratio to the lean side when the secondary air flow amount increases, and the target changing means changes the target air fuel ratio to the rich side when the secondary air flow amount decreases.

3. The fuel injection amount control device according to claim 1, wherein the guard value is set in accordance with the secondary air flow amount and an allowable combustion air fuel ratio, within which the air fuel ratio of mixture gas burned in the internal combustion engine is allowed.

4. The fuel injection amount control device according to claim 3, wherein the allowable combustion air fuel ratio is calculated in accordance with temperature of the internal combustion engine.

5. The fuel injection amount control device according to claim 1, wherein the fuel amount correcting means calculates an increasing correction amount, which is used when secondary air is supplied, in accordance with the target air fuel ratio when secondary air is supplied and change in the secondary air flow amount with respect to an intake air amount of the internal combustion engine, and the fuel injection amount is corrected using the increasing correction amount.

6. A fuel injection amount control device for an internal combustion engine, the fuel injection amount control device comprising:

a secondary air supply device that supplies secondary air into an exhaust passage of the internal combustion engine;

flow amount calculating means that calculates a secondary air flow amount, the secondary air flowing into the exhaust passage;

target air fuel ratio setting means that sets a target air fuel ratio when secondary air is supplied;

fuel amount correcting means that corrects a fuel injection amount in accordance with a current value of the secondary air flow amount such that the air fuel ratio on a downstream side of an inlet of secondary air in the exhaust passage becomes the target air fuel ratio when secondary air is supplied;

target changing means that monitors increase and decrease in the secondary air flow amount, the target changing means changing the target air fuel ratio to one of a rich side and a lean side in accordance with the increase and decrease in the secondary air flow amount; and air fuel ratio detecting means that detects the air fuel ratio on the downstream side of the inlet of secondary air in the exhaust passage, wherein the air fuel ratio detected using the air fuel ratio detecting means is feedback controlled such that the air fuel ratio coincides with the target air fuel ratio, and the fuel amount correcting means calculates an air fuel ratio correction amount in accordance with a deviation between the air fuel ratio, which is detected using the air fuel ratio detecting means, and the target air fuel ratio to correct a fuel injection amount using the air fuel ratio correction amount, instead of correcting the fuel injection amount in accordance with the secondary air flow amount.

7. The fuel injection amount control device according to claim 6, wherein when secondary air is supplied, a feedback gain is variably set to calculate the air fuel ratio correction amount in accordance with one of the secondary air flow amount and pulsation of exhaust gas caused in the exhaust passage.

8. The fuel injection amount control device according to claim 6, further comprising:

means for setting a correction amount guard value on at least an increasing side of the air fuel ratio correction amount in accordance with the secondary air flow amount when secondary air is supplied, wherein when the air fuel ratio correction amount reaches the correction amount guard value, the air fuel ratio correction amount is restricted with the guard value.

9. The fuel injection amount control device according to claim 8, wherein the correction amount guard value is set in accordance with the secondary air flow amount and the target air fuel ratio.

10. The fuel injection amount control device according to claim 8, wherein the guard value for the air fuel ratio correction amount in a normal feedback control of the air fuel ratio is corrected in accordance with at least the secondary air flow amount to set the correction amount guard value, and secondary air is not supplied in the normal feedback control of the air fuel ratio.

11. The fuel injection amount control device according to claim 8, further comprising:

means for restricting a rate of change in the correction amount guard value.

12. A fuel injection amount control device for an internal combustion engine, the fuel injection amount control device comprising:

a secondary air supply device that supplies secondary air into an exhaust passage of the internal combustion engine;

flow amount calculating means that calculates a secondary air flow amount, the secondary air flowing into the exhaust passage;

target air fuel ratio setting means that sets a target air fuel ratio when secondary air is supplied;

fuel amount correcting means that corrects a fuel injection amount in accordance with a current value of the secondary air flow amount such that the air fuel ratio on a downstream side of an inlet of secondary air in the exhaust passage becomes the target air fuel ratio when secondary air is supplied; and target changing means that monitors increase and decrease in the secondary air flow amount, the target changing means changing the target air fuel ratio to one of a rich side and a lean side in accordance with the increase and decrease in the secondary air flow amount;

wherein the flow amount calculating means calculates secondary air flow amount in accordance with secondary air supply pressure and standard pressure, the secondary air supply pressure is detected in a condition in which the secondary air supply device supplies secondary air, and the standard pressure is detected in a condition different from the condition in which the secondary air supply device supplies secondary air.

13. The fuel injection amount control device according to claim 12, wherein the standard pressure is shutoff pressure that is detected in a condition in which a secondary air supply passage is closed, and the secondary air supply passage is connected with the secondary air supply device.

14. A fuel injection amount control device for an internal combustion engine, the fuel injection amount control device comprising:

a secondary air supply device that supplies secondary air into an exhaust passage of the internal combustion engine;

flow amount calculating means that calculates a secondary air flow amount, the secondary air flowing into the exhaust passage;

target air fuel ratio setting means that sets a target air fuel ratio when secondary air is supplied;

fuel amount correcting means that corrects a fuel injection amount in accordance with a current value of the secondary air flow amount such that the air fuel ratio on a downstream side of an inlet of secondary air in the exhaust passage becomes the target air fuel ratio when secondary air is supplied; and target changing means that monitors increase and decrease in the secondary air flow amount, the target changing means changing the target air fuel ratio to one of a rich side and a lean side in accordance with the increase and decrease in the secondary air flow amount;

wherein the flow amount calculating means calculates secondary air flow amount in accordance with secondary air supply pressure and exhaust gas pressure, the secondary air supply pressure is detected in a condition in which the secondary air supply device supplies secondary air, and the exhaust gas pressure is pressure in the exhaust passage.

15. A fuel injection amount control device for an internal combustion engine, the fuel injection amount control device comprising:

a secondary air supply device that supplies secondary air into an exhaust passage of the internal combustion engine;

flow amount calculating means that calculates a secondary air flow amount, the secondary air flowing into the exhaust passage;

target air fuel ratio setting means that sets a target air fuel ratio on a downstream side of an inlet of secondary air in the exhaust passage;

air fuel ratio detecting means that detects an actual air fuel ratio on the downstream side of the inlet of secondary air in the exhaust passage; and air fuel ratio correction amount calculating means that calculates an air fuel ratio correction amount in accordance with a deviation between an air fuel ratio detected using the air fuel ratio detecting means and the target air fuel ratio, wherein the air fuel ratio is feedback controlled using the air fuel ratio correction amount calculated using the air fuel ratio correction amount calculating means, the fuel injection amount control device further comprising:

guard setting means that sets a correction amount guard value on at least an increasing side of the air fuel ratio correction amount in accordance with the secondary air flow amount calculated using the flow amount calculating means when secondary air is supplied; and correction amount restricting means that restricts the air fuel ratio correction amount with the correction amount guard value, which is set using the guard setting means.

16. The fuel injection amount control device according to claim 15, wherein the guard setting means sets the correction amount guard value in accordance with the secondary air flow amount and the target air fuel ratio.

17. The fuel injection amount control device according to claim 15, wherein the guard setting means sets the correction amount guard value by correcting the guard value of the air fuel ratio correction amount in a normal feedback control, in which secondary air is not supplied, in accordance with at least the secondary air flow amount.

18. The fuel injection amount control device according to claim 15, further comprising:

means for restricting a rate of change in the correction amount guard value.

19. The fuel injection amount control device according to claim 15, wherein the correction amount guard value, which is set using the guard setting means, is set as a first correction amount guard value, the air fuel ratio correction amount is restricted using the first correction amount guard value and a second correction amount guard value, and the second correction amount guard value is set in accordance with an allowable combustion air fuel ratio, within which the air fuel ratio of mixture gas burned in the internal combustion engine is allowed.

20. The fuel injection amount control device according to claim 15, wherein the flow amount calculating means calculates secondary air flow amount in accordance with secondary air supply pressure and standard pressure, the secondary air supply pressure is detected in a condition in which the secondary air supply device supplies secondary air, and the standard pressure is detected in a condition different from the condition in which the secondary air supply device supplies secondary air.

21. The fuel injection amount control device according to claim 20, wherein the standard pressure is shutoff pressure that is detected in a condition in which a secondary air supply passage is closed, and the secondary air supply passage is connected with the secondary air supply device.

22. The fuel injection amount control device according to claim 15, wherein the flow amount calculating means calculates secondary air flow amount in accordance with secondary air supply pressure and exhaust gas pressure, the secondary air supply pressure is detected in a condition in which the secondary air supply device supplies secondary air, and the exhaust gas pressure is pressure in the exhaust passage.

23. A fuel injection amount control device for an internal combustion engine, the fuel injection amount control device comprising:

a secondary air supply device that supplies secondary air into an exhaust passage of the internal combustion engine;

target air fuel ratio setting means that sets a first target value as a target air fuel ratio when secondary air is supplied, the target air fuel ratio setting means setting a second target value as a target air fuel ratio when secondary air is stopped;

fuel amount correcting means that corrects a fuel injection amount such that the air fuel ratio, which is on a downstream side of the inlet of secondary air in the exhaust passage, becomes the target air fuel ratio; and target value changing means, wherein when the target air fuel ratio is switched from the first target value to the second target value in a condition in which secondary air is stopped, the target value changing means initially sets the target air fuel ratio on a rich side with respect to the second target value, and thereafter changes the target air fuel ratio to the second target value; and wherein when secondary air, which is supplied, is stopped, the target value changing means initially sets a combustion air fuel ratio of the internal combustion engine as the target air fuel ratio, and the combustion air fuel ratio is estimated immediately before secondary air, which is supplied, is stopped.

24. A fuel injection amount control device for an internal combustion engine, the fuel injection amount control device comprising:

a secondary air supply device that supplies secondary air into an exhaust passage of the internal combustion engine;

target air fuel ratio setting means that sets a first target value as a target air fuel ratio when secondary air is supplied, the target air fuel ratio setting means setting a second target value as a target air fuel ratio when secondary air is stopped;

fuel amount correcting means that corrects a fuel injection amount such that the air fuel ratio, which is on a downstream side of the inlet of secondary air in the exhaust passage, becomes the target air fuel ratio; and target value changing means, wherein when the target air fuel ratio is switched from the first target value to the second target value in a condition in which secondary air is stopped, the target value changing means initially sets the target air fuel ratio on a rich side with respect to the second target value, and thereafter changes the target air fuel ratio to the second target value; and wherein when a difference between the combustion air fuel ratio, which is immediately before secondary air is stopped in the internal combustion engine, and the second target value is equal to or greater than a predetermined threshold, the target value changing means initially sets the target air fuel combustion ratio on the rich side with respect to the second target value.

25. The fuel injection amount control device according to claim 24, further comprising:

means for calculating an increasing correction amount, which is used when secondary air is supplied, in accordance with a current value of the target air fuel ratio when secondary air is supplied, such that the air fuel ratio, which is on the downstream side of the inlet of secondary air in the exhaust passage, becomes the target air fuel ratio, wherein the combustion air fuel ratio is estimated based on the increasing correction amount.

26. The fuel injection amount control device according to claim 23, wherein the target value changing means gradually changes the target air fuel ratio to the second target value after setting the target air fuel ratio on the rich side with respect to the second target value.

27. The fuel injection amount control device according to claim 23, wherein when the target air fuel ratio is set on the rich side with respect to the second target value, the target air fuel ratio is restricted with an air fuel ratio guard value, which is set to confine emission of exhaust gas within an allowable level.

28. A fuel injection amount control device for an internal combustion engine, the fuel injection amount control device comprising:

a secondary air supply device that supplies secondary air into an exhaust passage of the internal combustion engine;

target air fuel ratio setting means that sets a first target value as a target air fuel ratio when secondary air is supplied, the target air fuel ratio setting means setting a second target value as a target air fuel ratio when secondary air is stopped;

fuel amount correcting means that corrects a fuel injection amount such that the air fuel ratio, which is on a downstream side of the inlet of secondary air in the exhaust passage, becomes the target air fuel ratio; and target value changing means, wherein when the target air fuel ratio is switched from the first target value to the second target value in a condition in which secondary air is stopped, the target value changing means initially sets the target air fuel ratio on a rich side with respect to the second target value, and thereafter changes the target air fuel ratio to the second target value; and wherein the fuel injection amount control device further comprises:

air fuel ratio detecting means that detects the air fuel ratio on the downstream side of the inlet of secondary air in the exhaust passage, so that the air fuel ratio detected using the air fuel ratio detecting means is feedback controlled such that the air fuel ratio coincides with the target air fuel ratio, and wherein the fuel amount correcting means calculates an air fuel ratio correction amount in accordance with a deviation between the air fuel ratio, which is detected using the air fuel ratio detecting means, and the target air fuel ratio to correct the fuel injection amount using the air fuel ratio correction amount.

29. A fuel injection amount control device for an internal combustion engine, the fuel injection amount control device comprising:

a secondary air supply device that supplies secondary air into an exhaust passage of the internal combustion engine;

target air fuel ratio seeing means that sets a first target value as a target air fuel ratio when secondary air is supplied, the target air fuel ratio setting means setting a second target value as a target air fuel ratio when secondary air is stopped;

fuel amount correcting means that corrects a fuel injection amount such that the air fuel ratio, which is on a downstream side of the inlet of secondary air in the exhaust passage, becomes the target air fuel ratio; and target value changing means, wherein when the target air fuel ratio is switched from the first target value to the second target value in a condition in which secondary air is stopped, the target value changing means initially sets the target air fuel ratio on a rich side with respect to the second target value, and thereafter changes the target air fuel ratio to the second target value;

wherein the flow amount calculating means calculates secondary air flow amount in accordance with secondary air supply pressure and standard pressure, the secondary air supply pressure is detected in a condition in which the secondary air supply device supplies secondary air, and the standard pressure is detected in a condition different from the condition in which the secondary air supply device supplies secondary air.

30. The fuel injection amount control device according to claim 29, wherein the standard pressure is shutoff pressure that is detected in a condition in which a secondary air supply passage is closed, and the secondary air supply passage is connected with the secondary air supply device.

31. A fuel injection amount control device for an internal combustion engine, the fuel injection amount control device comprising:

a secondary air supply device that supplies secondary air into an exhaust passage of the internal combustion engine;

target air fuel ratio setting means that sets a first target value as a target air fuel ratio when secondary air is supplied, the target air fuel ratio setting means setting a second target value as a target air fuel ratio when secondary air is stopped;

fuel amount correcting means that corrects a fuel injection amount such that the air fuel ratio, which is on a downstream side of the inlet of secondary air in the exhaust passage, becomes the target air fuel ratio; and target value changing means, wherein when the target air fuel ratio is switched from the first target value to the second target value in a condition in which secondary air is stopped, the target value changing means initially sets the target air fuel ratio on a rich side with respect to the second target value, and thereafter changes the target air fuel ratio to the second target value;

wherein the flow amount calculating means calculates secondary air flow amount in accordance with secondary air supply pressure and exhaust gas pressure, the secondary air supply pressure is detected in a condition in which the secondary air supply device supplies secondary air, and the exhaust gas pressure is pressure in the exhaust passage.

* * * * *